US011184955B2

(12) United States Patent
Katz et al.

(10) Patent No.: US 11,184,955 B2
(45) Date of Patent: Nov. 23, 2021

(54) SYSTEM AND METHOD FOR PRODUCING AN ENGINEERED IRRADIATION PATTERN IN A NARROWBAND SYSTEM

(71) Applicant: Pressco IP LLC, Cleveland, OH (US)

(72) Inventors: Jonathan M. Katz, Solon, OH (US); Benjamin D. Johnson, Northfield, OH (US); Don W. Cochran, Gates Mills, OH (US); David W. Cochran, Orange, OH (US)

(73) Assignee: PRESSCO IP LLC, Cleveland, OH (US)

( * ) Notice: Subject to any disclaimer, the term of this patent is extended or adjusted under 35 U.S.C. 154(b) by 839 days.

(21) Appl. No.: 15/411,501

(22) Filed: Jan. 20, 2017

(65) Prior Publication Data

US 2017/0215233 A1 Jul. 27, 2017

Related U.S. Application Data

(60) Provisional application No. 62/286,029, filed on Jan. 22, 2016.

(51) Int. Cl.

| | |
|---|---|
| ***H05B 3/00*** | (2006.01) |
| ***F24C 7/04*** | (2021.01) |
| ***H05B 3/62*** | (2006.01) |

(52) U.S. Cl.

CPC ..... *H05B 3/0076* (2013.01); *F24C 7/046* (2013.01); *H05B 3/62* (2013.01); *H05B 2203/032* (2013.01)

(58) Field of Classification Search

CPC ..... F24C 7/04; F24C 7/046; G02B 19/009; G02B 19/0052; G02B 26/005; G02B 26/08; G02B 26/0816; G02B 26/0825; G02B 26/0833; H05B 3/0033; H05B 3/0076; H05B 3/36; H05B 3/62; H05B 2203/037; H05B 2203/032; H05B 1/0263; H01S 5/005; H01S 5/0071; H01S 5/46; H01S 5/426; B65B 25/22; B29C 2035/00822; B29C 2035/0838

See application file for complete search history.

(56) References Cited

U.S. PATENT DOCUMENTS

| | | | |
|---|---|---|---|
| 3,242,804 | A | 3/1966 | Brinkmann |
| 3,632,200 | A | 1/1972 | Frey |
| 4,455,319 | A | 1/1984 | Clark |
| 4,453,806 | A | 6/1984 | Wick |

(Continued)

FOREIGN PATENT DOCUMENTS

| | | | |
|---|---|---|---|
| AU | 2014 202 581 | A1 | 6/2014 |
| CN | 1556910 | A | 12/2004 |

(Continued)

OTHER PUBLICATIONS

International Search Report for PCT/US2017/014381 dated Mar. 31, 2017.

(Continued)

*Primary Examiner* — Shawntina T Fuqua
(74) *Attorney, Agent, or Firm* — Fay Sharpe LLP

(57) ABSTRACT

This application is related to a method and construction technology for the implementation of narrowband, digital heat injection technology. More specifically, it relates to techniques for implementations thereof producing engineered irradiation patterns.

30 Claims, 15 Drawing Sheets

(56) References Cited

U.S. PATENT DOCUMENTS

| | | | | |
|---|---|---|---|---|
| 5,345,466 | A | 9/1994 | Macomber | |
| 5,867,521 | A | 2/1999 | Macomber | |
| 6,037,580 | A | 3/2000 | Renk | |
| 6,195,381 | B1 | 2/2001 | Botez et al. | |
| 6,348,676 | B2 | 2/2002 | Kim et al. | |
| 6,359,256 | B1 | 3/2002 | Biermann et al. | |
| 6,594,090 | B2 | 7/2003 | Kruschwitz et al. | |
| 6,826,267 | B2 | 11/2004 | Daum | |
| 7,118,563 | B2 | 10/2006 | Weckworth et al. | |
| 7,150,552 | B2 | 12/2006 | Weidel | |
| 7,184,614 | B2 | 2/2007 | Slatkine | |
| 7,336,895 | B2 | 2/2008 | Okazaki | |
| 7,425,296 | B2 | 9/2008 | Cochran et al. | |
| 9,282,851 | B2 | 3/2016 | Cochran et al. | |
| 9,606,004 | B2 | 3/2017 | Hwang et al. | |
| 10,159,113 | B2 | 12/2018 | Möench et al. | |
| 10,687,391 | B2 | 6/2020 | Cochran et al. | |
| 2002/0137311 | A1 | 9/2002 | Timans | |
| 2003/0002548 | A1 | 1/2003 | Boscha | |
| 2004/0066817 | A1 | 4/2004 | Ungar | |
| 2005/0180482 | A1 | 8/2005 | Osowski et al. | |
| 2005/0238079 | A1 | 10/2005 | Botez | |
| 2007/0096352 | A1 | 5/2007 | Cochran et al. | |
| 2008/0245788 | A1 | 10/2008 | Choong et al. | |
| 2008/0314891 | A1 | 12/2008 | Takita | |
| 2011/0002677 | A1 | 1/2011 | Cochran et al. | |
| 2012/0196011 | A1 | 8/2012 | Felix | |
| 2012/0319016 | A1* | 12/2012 | Kuhlman ..... | F24C 7/04 250/505.1 |
| 2013/0344208 | A1 | 12/2013 | Singh | |

FOREIGN PATENT DOCUMENTS

| | | | |
|---|---|---|---|
| CN | 1977130 | A | 6/2007 |
| CN | 103323121 | A | 9/2013 |
| CN | 103460795 | A | 12/2013 |
| CN | 103727567 | A | 4/2014 |
| WO | WO 2004/009318 | A1 | 1/2004 |
| WO | WO 2008/075280 | A1 | 6/2008 |
| WO | 2008154503 | * | 12/2008 |
| WO | WO 2008/154503 | A2 | 12/2008 |

OTHER PUBLICATIONS http://www.thorlabs.com/NewGrougPage9_PDF.cfm?Guide=10&Categ . . . , Thorlabs, Engineered Diffusers, 7 pages, printed Apr. 5, 2013.

http://wot.motortrend.com/bmw-shows-us-how-its-laser-headlights-and-dyna . . . , Scott Evans, "BMW's Laser Headlights—BMW Shows us How its Freakin' Laser Light Show works," 5 pages, printed Jan. 3, 2012 (copyright 2012).

http://inhabitat.com/dont-make-eye-contact-electric-audi-a2-concept-will-pac . . . , Laura K. Cowan, "Don't Make Eye Contact: Electric Audi A2 Concept Will Pack Laser Tail Lights," 9 pages, printed Oct. 23, 2019 (dated Sep. 8, 2011).

http://rayotek.com/tech-specs/material-comparisons.htm, "Choosing the Right Material What is the difference between glass and crystalline material?" Rayotek Scientific Inc. Synthetic Sapphira vs. Glass, Fused Quartz & Silica, (4 pages—Wayback Machine—Internet Archive, Dec. 4, 2011; 3 pages printed Dec. 19, 2011).

Tasso R. M. Sales, Structured Microlens Arrays for Beam Shaping, Proceedings of SPIE Vo. 5175 Laser Beam Shaping IV, pp. 109-120, 2003.

Tasso Sales et al., Microlens diffusers and beam shapers for light-emitting diode (LED) sources, Optics InfoBase, pp. 1-2, printed Apr. 5, 2013.

Supplementary European Search Report for EP 17 74 2031 dated Jul. 15, 2019.

* cited by examiner

SYSTEM AND METHOD FOR PRODUCING AN ENGINEERED IRRADIATION PATTERN IN A NARROWBAND SYSTEM

This application is based on and claims priority to U.S. Provisional Application No. 62/286,029, filed Jan. 22, 2016, which is incorporated herein by reference in its entirety.

TECHNICAL FIELD

The field of this application is related to a method and construction technology for the implementation of narrowband, digital heat injection technology. More specifically, it teaches novel techniques for implementations thereof producing engineered irradiation patterns.

BACKGROUND

Narrowband digital heat injection techniques have been taught, for example, in U.S. Pat. No. 7,425,296 (which is incorporated herein by reference) and U.S. patent application Ser. No. 12/718,899, filed Mar. 5, 2010 (which is incorporated herein by reference), and others. What is not taught in any of the prior narrowband heating technology applications is a methodology for heating, cooking, curing, or de-icing which can be practiced safely without some form of containment of the photons. Also missing is an engineered methodology for "smoothing" the field of irradiation to provide for the right mix of radiant energy at appropriate locations on the target by way of a novel use of, for example, diffusers. Heretofore, all of the heating by way of narrowband irradiation has necessarily had to include various forms of protective goggles, face shields, containment within a cavity, optical isolation, or the use of protective clothing and/or other physical barriers which are not substantially transmissive of the wavelength(s) being employed. The thresholds and the particular safety measures to be taken are laid out in the American National Standard Institute (ANSI) Z136.1 series of standards. These industry-accepted safety standards specify the maximum permissible exposures for narrowband point sources and the mitigation measures that should be used to make them safe for the users.

Intense, narrowband photonic energy has an inherent danger and must be treated respectfully and used properly to affect a safe system. The term narrowband is used throughout to mean photonic energy whose full width, half max bandwidth is less than 150 nanometers, but in actual practice may often be less than 15 nanometers. Although other types of narrowband irradiation sources are available, the most commonly available and which would most likely be used in conjunction with digital heat injection technology are LED's, lasers, and laser diodes. Over the last several decades, LED's have become increasingly more powerful. A recent news article indicated that LED's have had an average increase in power of about 23% per year for each of the last twenty years. It is now possible to get single LED devices which can produce approximately twenty optical watts of power and the power output capabilities are expected to continue rising. Individual devices are rising in power and are beginning to be more useful individually for digital heat injection applications. Often and historically, LEDs have been arrayed in various manners in order to produce enough collective power to make digital heat injection applications possible.

Lasers are the other type of popular narrowband irradiation source and they are available in a wide range of different types for different purposes. It is beyond the scope of this application to describe all the different types of lasers, and new types are being invented on an ongoing basis. They generally fall into the categories of gas lasers, chemical lasers, solid state lasers, and semiconductor lasers. Photon-transistors and graphene devices which produce a photonic output are still the development laboratory, but there are indications that they may have substantial narrowband output at a high efficiency at some point in the near future. This would make them players in the narrowband irradiation field and they would benefit from this invention as well.

Although any type of lasers can be employed to perform narrowband heating applications, semiconductor lasers are easily the most adaptable. They are typically and increasingly the most economical types to employ. Semiconductor lasers lend themselves to being arrayed with other devices so that the overall power and geometric configurations fit well with the application. For example, if it is desirable to heat a target item which has a large surface area by way of laser irradiation, arrays can be constructed which have the width, breadth, and complement of semiconductor lasers which will facilitate the emission pattern that will cover the entire target appropriately and with the required power density.

As an array is being designed, careful consideration must be made of the specific irradiation pattern of each semiconductor laser device which comprises the array. Some individual devices will have a rectangular irradiation output pattern while others may have a circular or elliptical output pattern. Typically, there is also what are known as a fast and a slow divergence axis which are located 90 degrees rotated from one another along the center line of the device's output pattern. Conventional edge-emitting laser diodes will typically have divergence angles of X in the fast direction and Y in the slow direction. While VCSELS (vertical cavity surface emitting lasers) have a conical divergence pattern of approximately Z degrees and SEDFB (surface emitting distributed feedback) devices are columnated or non-diverging in one axis and slightly diverging at six to ten degrees in the other axis.

The designer of a DHI irradiation system must design each array with consideration for the distribution of energy intensity at the far field plane or 3D surface of an intended target. In order to accomplish this, the output of each individual device must be understood and modeled into the array layout. Since conventional edge emitting laser diodes have a roughly Gaussian output in each of the diversion axis, this can be somewhat challenging. SEDFB devices have a roughly flat field, rectangular output but they must still be arrayed very carefully so that the irradiation pattern overlaps are accommodated in the design.

The energy intensity must also be well understood throughout the laser irradiation chain for other reasons. As was mentioned above, it is important to be able to even-out or at least understand, if homogeneous irradiation is not intended, how the irradiation will be received by the target to achieve the desired heating or perhaps cooking result. The irradiation pattern and intensity of the laser chain must be understood for another important reason as well. The inherent safety to humans, animals and property must be considered very carefully. In most countries, for safety reasons, there are regulatory concerns within which a design must be constrained which specify the maximum intensity per unit area which is allowed.

In addition to the energy intensity or density, there is another important aspect to consider in making a narrowband irradiation system safe. If the energy is produced from what can practically be considered a "point source", which is the case for all narrowband sources that can be considered a laser, the concern is that the energy can be refocused through the lens of the eye to a point spot on the retina of a human or animal. Various optical circumstances in the environment could help to inadvertently re-focus the energy back through the eye to a small enough spot to be damaging on the retina. At specific wavelengths above about 1,300 nanometers, the molecular absorption characteristics in the cornea of the eye would absorb enough photonic energy to prevent it from reaching the retina. Although there is substantial absorption in some of the medium and long wave infrared bands, it must be assumed that good practice and engineering will try to protect the eyes and skin from refocusing point source energy to a spot small enough to cause damage, the thresholds of which are defined in the ANSI Z136.1 series of standards. It is therefore necessary to pay careful attention in the design of an irradiation system which uses point sources such as LEDs and laser diodes in the range from short ultraviolet (UV) through to long infrared (LIR), especially if those point source devices have considerable irradiation flux power.

Another critically important challenge related to narrowband irradiation for the purpose of heating, cooking, thawing, curing or the like would be the challenge of getting the right amount of energy to the right areas of the target to accomplish the intended work. To clarify, the "natural" irradiation pattern of a device or array of devices will almost certainly not correspond to the shape of the target so that the right amount of irradiation energy reaches every desired part of the target. As a simple example, an array of 5×5 (25 devices) SEDFB devices may have a natural irradiation pattern which measures 3 inches by 4 inches at the target plane. If the target to be irradiated has a size of approximately 6 inches by 8 inches, then additional engineered divergence needs to be invoked to cover a target region of approximately twice as much in both the X and the Y directions. If a heating system or cooking oven is being designed to sometimes irradiate a 6 inch by 8 inch area for some applications, but for other applications would desirously irradiate a 10 inch by 14 inch target plane, then a dilemma exists. If it is designed to irradiate the 10 inch by 14 inch target area, then the thermal flux is spread over 140 square inches. When the target would fit nicely within the 6 inch by 8 inch target plane area, then it would be wasting much of its thermal flux since only 48 square inches of irradiation area must be covered in this circumstance. Similarly, if an oven is designed for baking 15-inch round pizzas but may sometimes be used to cook a steak or a 5 inch by 7 inch frozen dinner, then the result would be unused cooking power that is not focused on the smaller targets. Since a 15-inch diameter pizza encompasses about 176 square inches (1,135 square centimeters) compared to about 35 square inches for the 5 inch by 7 inch target area (226 square centimeters), about 80% of the cooking power would simply not be utilized properly when cooking the smaller target area compared to the pizza. Depending on the design of the system, it would not be necessary to turn on all of the power that is available but that configuration would simply not use the available power to garner the speed advantages that might be available with more power focused on the right-sized target area.

One can imagine a whole range of situations like this and the resulting decisions required during the design of a heating system or cooking oven. It is, of course, related to the desired cavity size in the narrowband irradiation system as well. For example, there would be no point in having a large cavity which could accommodate larger surface area targets or comestibles if the narrowband irradiation configuration cannot irradiate the desired size target area. But there would be a substantial waste of energy and reduced performance if the energy was simply aimed at the entire footprint of the cavity when smaller targets are being heated or cooked.

There is a tension between having too small an irradiation target area which has a higher watt per unit area power density compared to a much larger target region which has a substantially lower power density per unit area. For many applications, the ratio of power density is the close approximation to the speed at which something can be heated, cured, or cooked. Using the example of the 15" pizza versus the 5 inch by 7 inch target area as mentioned above, we would expect the cooking time for a slice of pizza which fit into the 5 inch by 7 inch region to be approximately four to five times faster cooking than to cook the entire pizza by spreading the energy more broadly over five times more surface area. With reference to FIG. 11, a variety of different target regions are shown depicting different heating or cooking situations that may need to be accommodated in an oven or heating system.

SUMMARY

In one aspect of the presently described embodiments, a system for narrowband radiant heating of a target using an engineered irradiation pattern comprises a narrowband infrared semiconductor based emitter system, a target area, into which the target may be positioned, and an engineered component arranged in a beam path between the emitter system and the target area, the engineered component configured to modify shape and power density of output energy of the narrowband infrared emitter system to create the engineered irradiation pattern of the output energy in the target area.

In another aspect of the presently described embodiments, the emitter system comprises at least one narrowband infrared semiconductor radiation emitting device.

In another aspect of the presently described embodiments, the emitter system comprises an array of narrowband infrared semiconductor radiation emitting devices.

In another aspect of the presently described embodiments, the emitter system comprises a plurality of arrays of narrowband infrared semiconductor radiation emitting devices.

In another aspect of the presently described embodiments, the engineered component comprises at least one of a diffuser, a diffuser configuration, a lens, a diffraction grating, a Fresnel lens, a mirror, and a reflector.

In another aspect of the presently described embodiments, the engineered component comprises a micro-lens array that is matched to the geometry and output of the individual devices in an emitter array.

In another aspect of the presently described embodiments, the engineered component is mounted in a fixture to hold it in correct relationship with the emitter.

In another aspect of the presently described embodiments, the fixture contains more than one engineered component which is in the beam path.

In another aspect of the presently described embodiments, the fixture takes the form of one of a magazine, carousel, or other mechanical arrangement to interchange engineered components.

In another aspect of the presently described embodiments, the engineered component has diffusion characteristics that modify the output of the emitter system to mitigate the optical hazards of the unmodified output.

In another aspect of the presently described embodiments, the system has an open-framed arrangement for a user wherein a safety device interrupts the output of the emitter system when the user interacts physically into the target area.

In another aspect of the presently described embodiments, each of the arrays is matched with its own engineered component for modifying the engineered irradiation pattern that is created in the target area.

In another aspect of the presently described embodiments, each of the engineered components modifies the output energy to interact with a specific target with specific power density levels.

In another aspect of the presently described embodiments, an additional component is placed in the beam path between the engineered component and the target area to protect at least one of the engineered component or personnel.

In another aspect of the presently described embodiments, the additional component is configured to further modify the output of the emitter system.

In another aspect of the presently described embodiments, the system further comprises at least a portion of a cooking system.

In another aspect of the presently described embodiments, different engineered components facilitate different radiant intensity patterns.

In another aspect of the presently described embodiments, the interchangeable mechanical mounting facilitates swapping or cleaning of the engineered components.

In another aspect of the presently described embodiments, the magazine, carousel or interchangeable mechanical mounting can only be placed within the beam path through the use of a unique locating feature.

In another aspect of the presently described embodiments, the emitter system features one or more narrowband output wavelength ranges, each for their different heating result with the target.

In another aspect of the presently described embodiments, the radiation emitting devices are located in one or more orientations around the target area.

In another aspect of the presently described embodiments, the radiation emitting devices are located above and below the target area.

In another aspect of the presently described embodiments, the mounting fixture includes a locating feature to facilitate at least one of uniquely orienting an engineered component or to allow mounting of a correct engineered component for that location.

In another aspect of the presently described embodiments, the engineered irradiation pattern is one of a circle, a square, a triangle, a rectangle, an arc or a plurality of these shapes.

In another aspect of the presently described embodiments, a distance between the emitter system and the engineered component is adjustable to change the size of the engineered irradiation pattern.

In another aspect of the presently described embodiments, the target area is defined for a user with at least one of a visible optical pattern projection, a physical marking, or a graphical depiction.

In another aspect of the presently described embodiments, the target fits into a fixture that holds the target in a unique location position within the target area.

In another aspect of the presently described embodiments, a specific configuration of the engineered component is reported to at least one of a control system or the user.

In another aspect of the presently described embodiments, the interchangeable mechanical mounting is changed either automatically or manually in response to a signal from a control system.

In another aspect of the presently described embodiments, the narrowband infrared semiconductor based emitter system comprises a laser device, a laser diode, a surface emitting laser diode, or an SEDFB device.

In another aspect of the presently described embodiments, an oven for narrowband radiant heating of a food item using an engineered irradiation pattern comprises a narrowband infrared semiconductor based emitter array, a target area, into which the food item may be positioned, and a diffuser configuration arranged in a beam path between the emitter array and the target area, the diffuser configuration configured to modify shape and power density of output energy of the narrowband infrared emitter array to create the engineered irradiation pattern of the output energy in the target area to cook or heat the food item.

In another aspect of the presently described embodiments, the output energy exceeds 250 watts.

In another aspect of the presently described embodiments, output energy of at least two wavelength ranges separated by at least 175 nm is produced by the emitter array.

In another aspect of the presently described embodiments, a method for narrowband radiant heating of a target using an engineered irradiation pattern comprises emitting output narrowband infrared energy from a narrowband infrared semiconductor based emitter system toward a target area into which the target may be positioned, and modifying, using an engineered component arranged in a beam path between the emitter system and the target area, shape and power density of the output energy of the narrowband infrared emitter system to create the engineered irradiation pattern of the output energy in the target area.

In another aspect of the presently described embodiments, a method for narrowband radiant heating of a food item using an engineered irradiation pattern comprises emitting output narrowband infrared energy from a narrowband infrared semiconductor based emitter array toward a target area into which the food item may be positioned, and modifying, using a diffuser configuration arranged in a beam path between the emitter array and the target area, shape and power density of the output energy of the narrowband infrared emitter array to create the engineered irradiation pattern of the output energy in the target area to heat or cook the food item.

DETAILED DESCRIPTION

Figure 1:
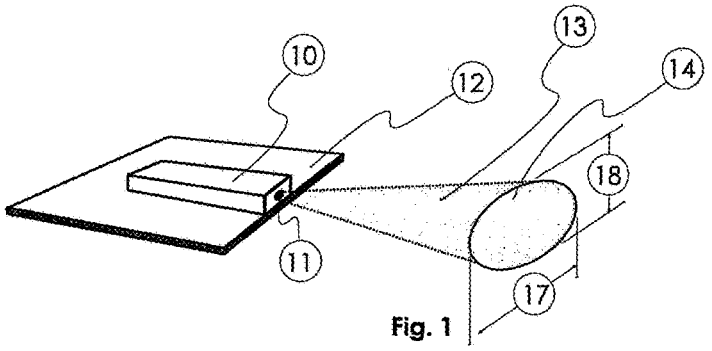
FIG. 1 illustrates an example output pattern for an emitting device.

The current application teaches novel implementations which will facilitate solutions to the difficult engineering challenges described above. It describes novel ways of implementing an arrangement or system, for example, specifically engineered or configured diffusers, into narrowband irradiation systems to eliminate the need for physical or opaque isolation and in many applications, can eliminate the need for goggles or filtration as the methodology to prevent exposure to the narrowband irradiation. It also facilitates redirecting the irradiation energy to differently shaped target areas by way of inserting elements, for example, different engineered components such as diffusers or other configurations or elements, which are right or suitable for each target size and shape.

It is possible to build narrowband irradiation systems (e.g. narrowband infrared semiconductor based emitter systems) with a single irradiation device (e.g. a narrowband infrared semiconductor based radiation emitting device) or with multiple such irradiation devices (e.g. including an array or arrays of such devices. When irradiation devices are utilized, they would typically be configured in some form of array so that the geometrical mounting arrangement of each device contributes appropriately so that the irradiation pattern at the target is right for the particular application. Certainly many different geometrical array arrangements could be devised for various purposes including circular arrangements, ring arrangements, and various 3-D array shapes, but for purposes of explanation in this application, planar, rectangular X by Y arrays will be used for the illustrations. Certainly the concepts apply to many different geometrical configurations and one of skill in the art would be able to apply these teachings accordingly.

As an example, an X by Y array of laser diodes may be configured so that at a standoff distance of a parallel measurement plane, six inches away from the plane of the array, there are no gaps in the irradiation patterns but there are predictable and appropriate overlaps in some of the patterns. Let's suppose the size of the total composite irradiation pattern is 3 inches by 5 inches at the 6 inch standoff measuring plane distance. Perhaps it is desirable to have the total irradiation pattern at that same standoff distance be modulated into a 6 inch by 8 inch irradiation pattern. Note that the X dimension (3 inch) would need to be doubled in width while the Y dimension of the pattern (5 inch) would only need to be increased by 60%. A diffuser configured or engineered such that it can be inserted in the beam path such that the irradiation from each device passes through a specific section of the diffuser on its way to the 6 inch measurement plane or target. The closer the diffuser is located to the devices themselves, the smaller the diffuser section could be which is made available to each device. A traditional, homogeneous diffuser inserted into the path of the example array, however, would be expected to provide approximately the same amount of diffusion or beam expansion in the X direction as in the Y direction. This may be perfectly acceptable, or even the most desirable, engineered result in many applications.

If, however, it is desirable to have a different amount of diffusion or beam expansion in the X direction compared to the Y direction, then a homogenous diffuser would not be dictated. In fact, commercially available devices can provide a diffuser which, experiments have verified, will diffuse sharply different amounts in the X direction compared to the Y direction. By working with specialty diffuser manufacturers, it is possible to specify the diffusion device so that the ratio of diffusion is perfect for the geometry of many different engineered circumstances. These diffusers can be manufactured from glass and can be directionally etched, pattern etched, or they can be molded out of plastic to provide the specifically desired nonhomogeneous diffusion. These specialized diffusers can provide even more usefulness specified and designed to provide nonlinear diffusion. This nonlinearity can be related to the specific diffusion in front of each individual laser diode or irradiation device so that either more or less diffusion occurs near the center of its output pattern while a different amount of diffusion occurs near the extremities of the output pattern. As was mentioned for sheet diffusers, each of the diffusion regions corresponding to individual laser diode devices would not have to be the same. The diffusion designed into an array diffuser for devices which are, for example, further from the center of an array could produce increasingly greater diffusion results or conversely less diffusion. By interposing different diffusion rates in different directions and in different positions either relative to the devices or to the array position, an infinite number of different irradiation patterns can be engineered to result at the measuring plane or irradiation target.

A very large range of specialty shapes can be projected after diffusers made by several commercially available diffusers, such as x-patterns, crossed patterns, circles (both hollow doughnut shapes and filled-in), hourglass shapes, square patterns, etc. Such diffusers can be purchased commercially to transform round, elliptical, or rectangular irradiation input into the aforementioned shapes. Non-linear, circularly asymmetrical, directional and many combinations could be designed into each diffuser section and then the composite array of sections, whose geometrical centers correspond to the diode centers, can be deployed very close to the diode array for an engineered irradiation result. Thus, in theory, each individual diode could be directed to the exact overall shape of the target area so that the outputs of each device would simply add to the power density at the targeted plane, and the loss of a single device would not result in a hole or gap in the composite irradiation pattern.

This novel way of incorporating the exact amount and shape dispersion pattern or diffusion that is desired, can have huge ramifications in terms of the irradiation pattern and the results of the irradiation work. Again, while X and Y directions have been used for purposes of discussion here, it is possible to design and implement precision irradiation dispersion or diffusion arrays which incorporate circularly nonhomogeneous, circularly symmetrical, or asymmetrical irradiation patterns to change, redirect, or correct the output of devices such as LEDs and VCSELs which have natively occurring conical irradiation patterns. They also often have circularly symmetrical Gaussian power distribution which can be re-mapped with engineered diffusion arrays. If properly designed, these nonhomogeneous diffusion arrays can provide critically important functionality for effective narrowband irradiation applications. It can provide the functionality of correcting the challenging output patterns of some types of devices and can better optimize the composite output patterns of even the best types of irradiation devices or device arrays.

This process of using engineered or specifically configured diffusion for narrowband irradiation systems, if implemented correctly, brings a whole additional range of benefits. The irradiation energy which has passed through a properly specified and configured diffuser cannot be refocused back to a point. This renders major eye and skin safety benefits. By diffusing the output to which the user may be exposed, the ANSI Z136.1 standards for the safe use of lasers no longer apply and the American Conference of Governmental Industrial Hygenists (ACGIH) Threshold Limit Values (TLVs) can instead be used. The ACGIH handbook defines the exposure limits for non-point source illumination sources of all kinds for a variety of exposure durations. By utilizing this novel technique, it is possible to design cooking, warming, or holding stations which utilize powerful narrowband energy but which do not have to completely contain said energy within an enclosure because it is safer because it cannot be refocused back into the small point size of the original source. It renders the radiant energy which has passed through the engineered diffuser as spatially incoherent. Although the energy density that is available in the irradiation field may still require appropriate safety precautions, it is possible to get away from the complete enclosing of the narrowband irradiation area.

For example, it can be desirable to design a narrowband irradiation system with open sides as long as the irradiation energy is carefully directed straight to the food or target item and not out into the surrounding environment of the cooking system. Using un-diffused narrowband point sources, the output of such a system (at an arbitrary near infrared wavelength) would be limited to 35 $W/m^2$ or a hazard zone greater than 15 meters (a hazard zone being defined as the region around an operational laser in which safety measures, such as goggles, must be observed). By comparison, a properly diffused narrowband source, wherein the light cannot be refocused down to a point source, can be operated with much higher energy density. The exact value of the allowable energy density depends on the expected exposure time, i.e. the duration during which the user could reasonably be expected to be in direct contact with the diffuse infrared energy. Direct exposure for greater than 17 minutes to an arbitrary near infrared wavelength must be kept to less than 100 $W/m^2$. If the infrared energy is directed such that it is NOT directly accessible to the user for long periods of time (such as the appliance shown in FIG. 9) and the user is only expected to interact directly with the illumination during brief loading or unloading procedures, then the TLV can be increased significantly. For example, if one assumes only 10 seconds of exposure to some arbitrary, diffuse near infrared wavelength while removing food from the appliance, the permissible energy density limit jumps to over 3,000 $W/m^2$ per the ACGIH guidelines.

If necessary or desirable, it is possible to use presence sensing technology to sense that a foreign object is being inserted into the irradiation field, such as a hand, so that the irradiation energy (which, for example in some cases, might exceed 250 watts of total photonic energy) is immediately stopped or made safe by modulation of some aspect of the irradiation energy output while there is an intrusion through a presence sensing field. This would leave only the exposure limitations on the energy scattered out of the cavity by the food or the appliance surfaces as direct exposure to the illumination would no longer be a concern. The presence sensing can take a number of forms including infrared, scanning infrared or other forms of either visible or invisible light curtains which sense anything passing through or inserted through a plane of detection. It also could utilize a capacitive field or RF field detection device which would sense that a body or other item is being inserted into a protection area or region. Protection could also be supplied by simpler or even more sophisticated means such as an electronic camera which is connected to appropriate computer processing technology such that an output signal can be sent to turn off the irradiation if a safety breach into the irradiation region is occurring. The camera-based sensing could also cause the system to modulate its output as a function of what is in the field of irradiation for the purpose of warming or holding accordingly. A range of different sensing devices and intelligence could be used to detect that a safety intrusion is occurring into the irradiation field. It would not have to result in turning off the energy but could actually turn the energy intensity down below a safety threshold level or turn off/down selected areas of irradiation which would not correspond to the intrusion proximity.

A selection of the advantages of the implementation of this invention in narrowband irradiation applications are listed below:

One advantage of the invention is that it will eliminate the need for physical or opaque isolation of narrowband irradiation sources to prevent the photonic energy from reaching the eyes or tissues of a person or animal.

Another advantage of the invention is that, because of the reduction of power density with the engineered diffusion, it can eliminate the need for safety goggles or special filtration disposed between the irradiation sources and a person or animal.

Yet another advantage of the invention is the facilitation of smoothing the irradiation intensity that hits a target or item to be heated or cooked.

Still another advantage of the invention is the facilitation of more flexibility of semiconductor irradiation device geometrical array arrangement.

Yet still another advantage of the invention is the facilitation of eliminating doors and mechanical interlocks disposed between the irradiation arrays and a user or casual passerby.

Another advantage of the invention is the ability to design a system which produces highly directed and specifically aimed photonic energy but rendering that photonic energy such that it cannot be refocused to a point source and is therefor much safer.

Another advantage of the invention is to facilitate the design of a narrowband irradiation system for heating, cooking, or holding which does not completely contain the photonic energy within an enclosure.

Another advantage of the invention is the facilitation of a narrowband heating, cooking or thermal holding system which can be, at least in part, "open air" or "open sided".

Yet still another advantage of this invention is the ability to design a narrowband irradiation system which incorporates electronic presence sensing devices instead of physical barriers to provide personnel safety.

And yet still another advantage of this invention is the ability to properly design systems which will incorporate more diffusion in the X axis versus the Y axis.

A further advantage of this invention is the ability to design narrowband irradiation systems with very specific irradiation patterns and energy densities to meet an application need.

A still further advantage of this invention is the facilitation of building narrowband de-icing systems that can safely coexist with humans or animals in various vehicular, aircraft, or general applications.

Another advantage of this technology yields the ability to interchange different diffusers at different times to yield the correct irradiation field size for a given application.

Another advantage would be the ability to utilize a much higher percent of the irradiation energy that is produced in an oven by focusing the energy into the desired shape, size, intensity and location.

Yet another advantage of the invention is the ability to focus the irradiation energy in an oven into multiple specifically sized and shaped regions.

Yet another advantage of the invention is the ability to direct the desired different intensity to different regions in a cooking field.

Yet another advantage of the invention is the ability to direct the irradiation energy to specifically shaped zones within a cooking region.

Yet another advantage of the invention is the ability to direct differing amounts of irradiation energy to each of the zones that may be targeted within the cooking region.

Yet another advantage of the invention is its ability to facilitate either manual or automatic changing of diffusers in an oven to suit the specific purpose.

Yet another advantage of the invention is the ability to combine the effects of different diffusers by stacking them so that the energy passes through them in a serial manner, thus having the combined effect.

Yet a further advantage of the invention is the facilitation that the control system can configure an arrangement of diffusers suited for an application and then either automatically index them into position in front of the narrowband array, or send instructions for manual positioning of such diffusers.

And still another advantage of this invention is the facilitation of dramatic energy savings by not sending or wasting the energy where it is not needed but rather directing it to the exact shape and concentration which is needed in each of the respective target regions within the irradiation system.

Figure 2:
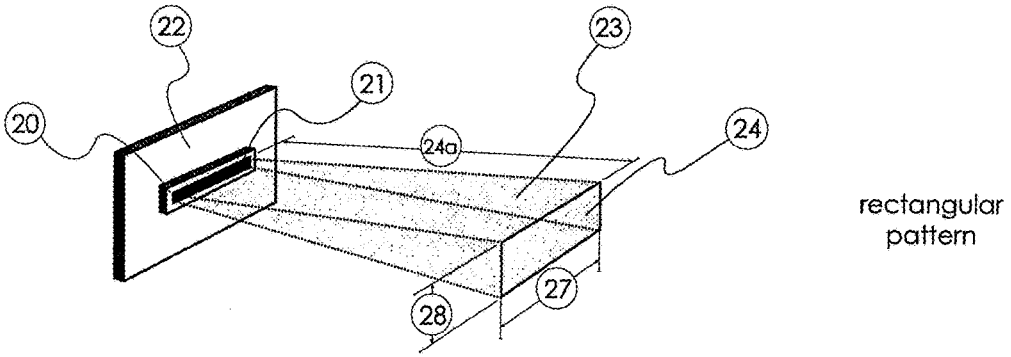
FIG. 2 illustrates an example output pattern for an emitting device.
Figure 3:
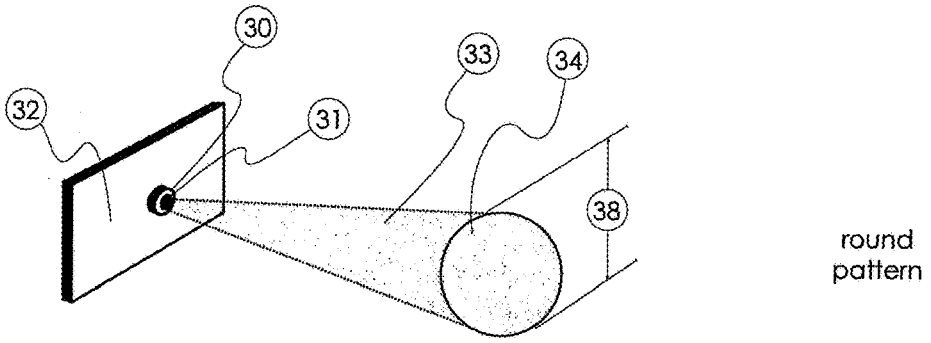
FIG. 3 illustrates an example output pattern for an emitting device.

With reference now to the drawings, the development of an engineered diffusion system for narrowband irradiation systems (e.g. narrowband infrared irradiation systems including at least one, or an array or arrays, of narrowband infrared semiconductor radiation emitting device(s)) must consider many aspects and characteristics of both the source and the target for the irradiation application. The irradiation patterns of the most typical laser diodes that might be employed can generally be categorized into an elliptical pattern as show in FIG. 1, a rectangular pattern as shown in FIG. 2, or a round pattern as shown in FIG. 3. Each of the respective devices (10 in FIG. 1, 20 in FIG. 2, and 30 in FIG. 3) are shown mounted to their respective circuit boards 12, 22 and 32 respectively, and irradiating in regions 13, 23, and 33. If the central axis of the irradiation pattern for each of the respective devices indicated in FIGS. 1, 2 and 3 is imagined to intersect with orthogonal plane, the respective irradiation patterns would be 14, 24, and 34. The elliptical pattern shown in FIG. 1 would be typical of an average edge emitting laser diode 10 whose irradiation exits the laser diode 10 through a facet 11 which would then create the irradiation pattern which exhibits a fast axis divergence 17 and a slow axis divergence 18. The round pattern as indicated in FIG. 3 would be more typical of an LED or a VCSEL device. Clustered VCELs or multiple VCELS on a single chip would typically look like their composite pattern is a round pattern as shown in FIG. 3 with a roughly Gaussian intensity distribution around the center of the pattern.

A surface emitting laser diode such an SEDFB would typically emit a rectangular pattern 24 as shown in FIG. 2. In the special case of an SEDFB type device, the fast divergence axis 28 would typically be in the six to ten degrees range. The slow axis 27 would typically be columnated or zero degrees of divergence. This is a major advantage in some laser applications because it only requires a simple cylindrical lens to columnate the "fast divergence" axis, resulting in a fully columnated device in both axes. This would be true for an individual device or to columnate an array of devices.

Figure 4:
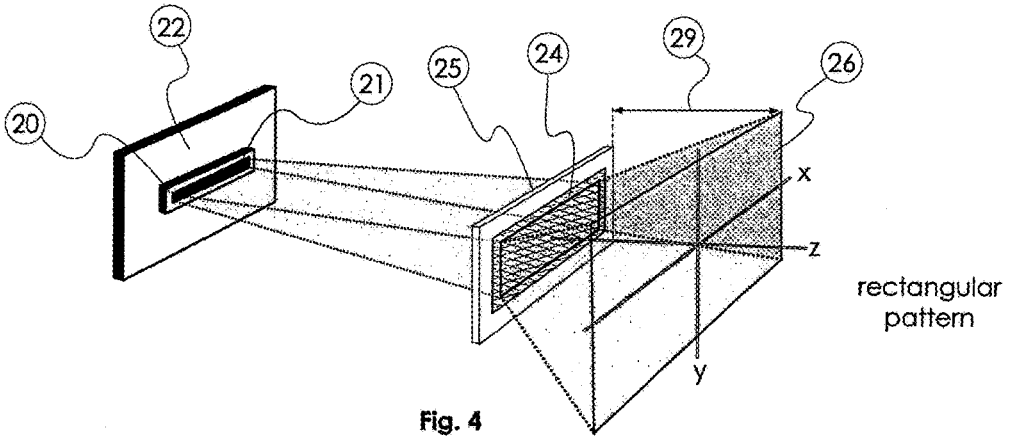
FIG. 4 illustrates features of an example embodiment according to the presently described embodiments.
Figure 5:
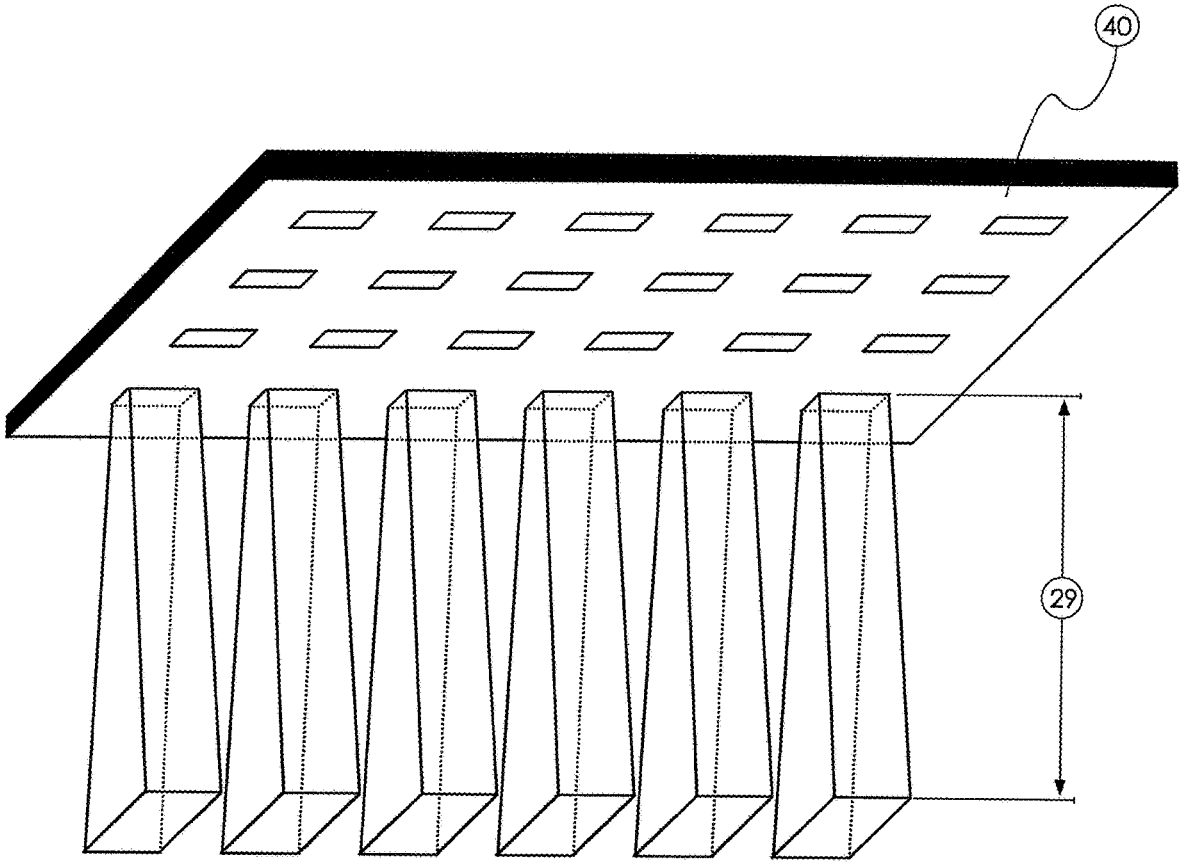
FIG. 5 illustrates features of an example embodiment according to the presently described embodiments.
Figure 6A:
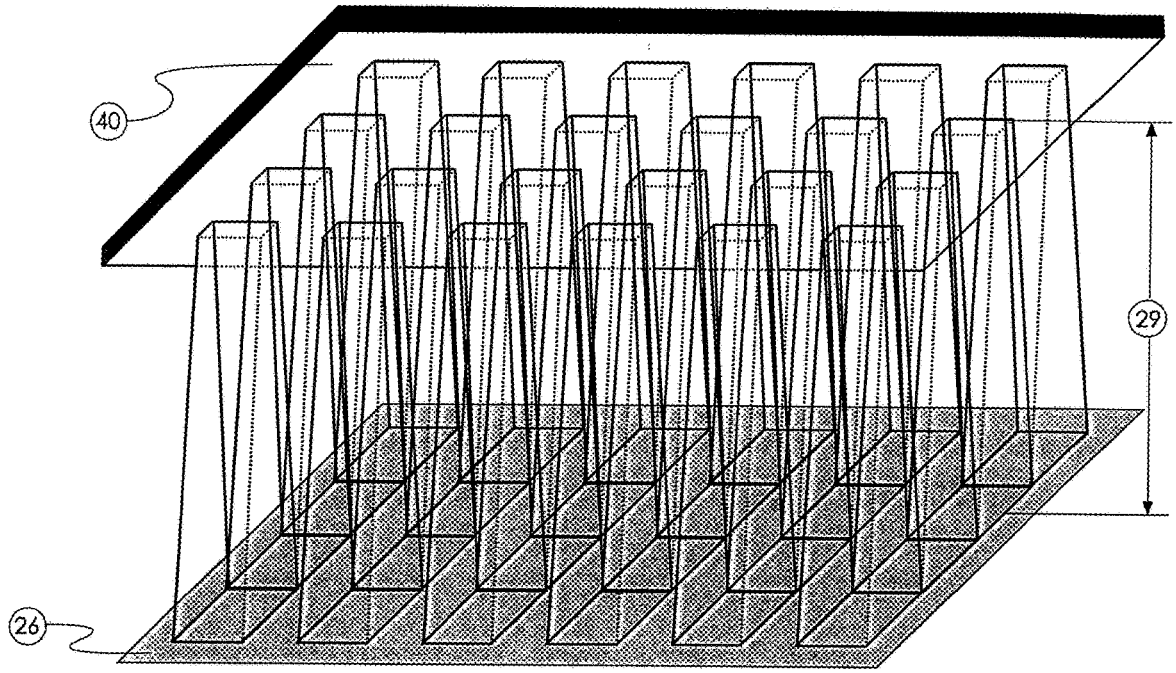
FIG. 6*a* illustrates features of an example embodiment according to the presently described embodiments.
Figure 6B:
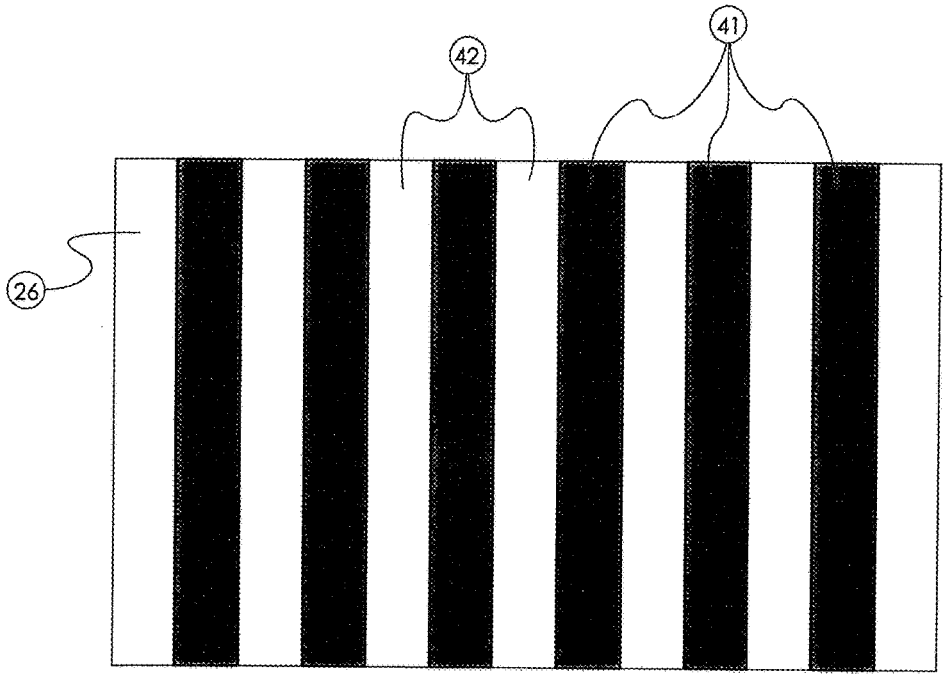
FIG. 6*b* illustrates features of an example embodiment according to the presently described embodiments.
Figure 6C:
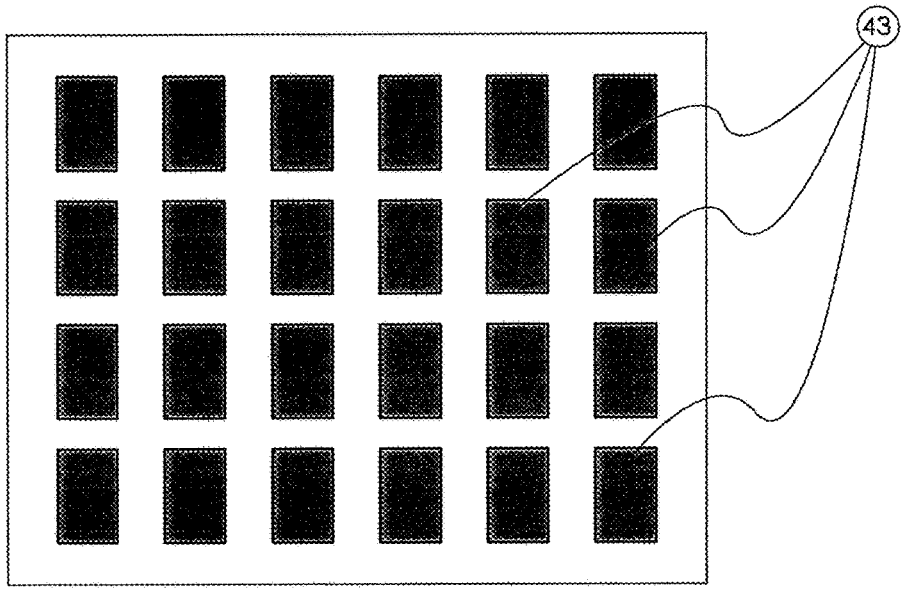
FIG. 6*c* illustrates features of an example embodiment according to the presently described embodiments.
Figure 6D:
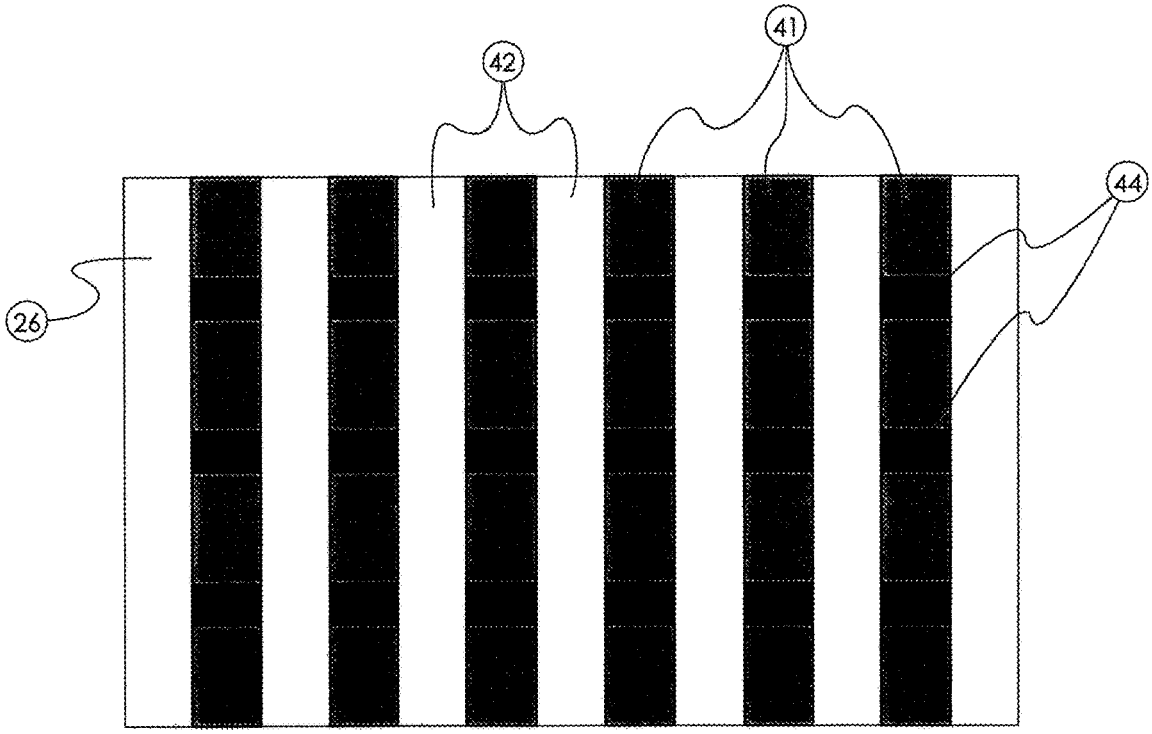
FIG. 6*d* illustrates features of an example embodiment according to the presently described embodiments.
Figure 7:
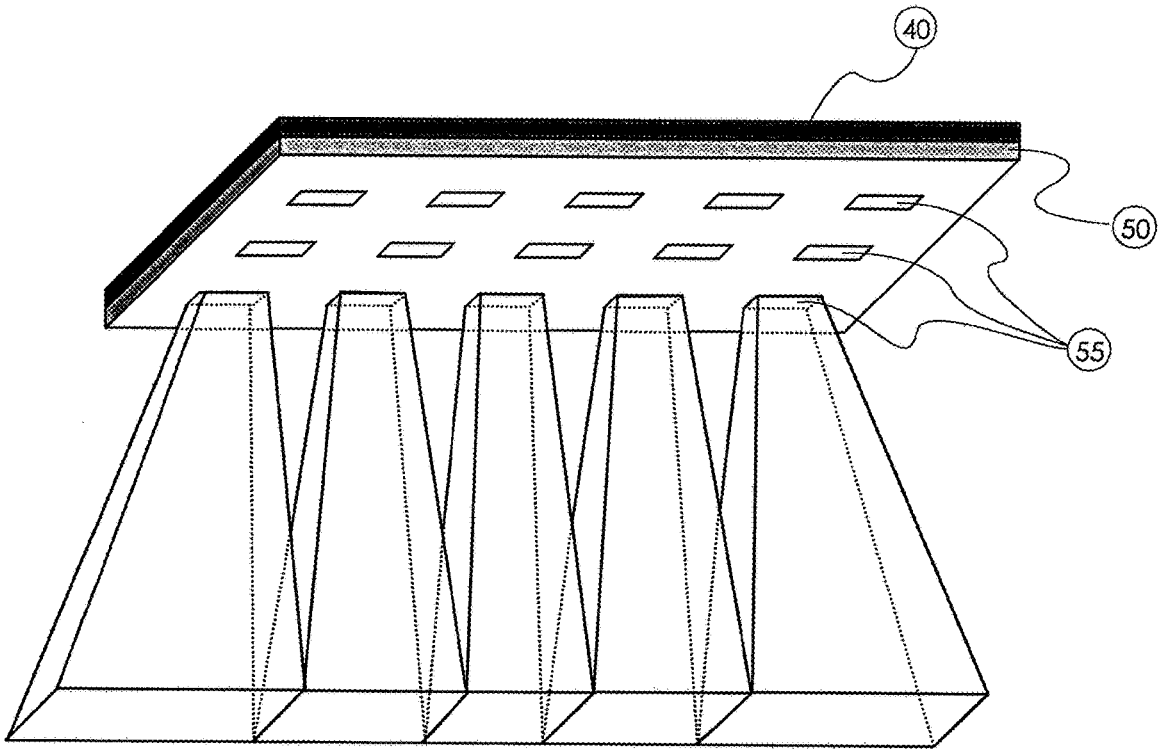
FIG. 7 illustrates features of an example embodiment according to the presently described embodiments.

As narrowband devices are configured into arrays, their projected irradiation pattern at a measurement plane 26 will be a composite of the output pattern of each individual device, as shown in FIGS. 4 and 6*a*. As shown in FIG. 5, a single row of SEDFBs might have an irradiation pattern as shown and that irradiation pattern would have gaps in it in one direction as a result of the output irradiation pattern of each SEDFB as shown in FIG. 2. The composite irradiation pattern of the composite array will be a function of the distance 29 to the measurement unless each individual device is columnated. It is often not practical to arrange the devices such that gaps are eliminated for various heat dissipation and mechanical mounting and wiring reasons. FIGS. 6*a* and 6*b* show the output of a 4×6 array of SEDFBs and that the native composite pattern would be a series of stripes 41 as shown in FIG. 6*b*. There would also be stripe gaps 42 as shown in FIG. 6*b*. If the distance 29 is less than a minimum distance at which the native output patterns begin to overlap, then the result would be gaps between the pattern 43, as shown in FIG. 6*c*. Conversely, if distance 29 is greater than an overlapped condition as shown in FIG. 6*d*, overlapped regions 44 will result as represented in FIG. 6*d*.

For some applications it is quite critical to have extremely uniform irradiation at the target plane 26. For other applications, it is far less critical and slight underlap or overlap of irradiation patterns is not concerning. With some exceptions, it is not generally desirable to have large gaps 42 between the irradiation patterns. The criticality of this parameter is left to the designer and implementer of the invention. Sometimes, the arrangement of the devices on the array board 40 can sufficiently alleviate the overlap, underlap, and gaps situation. Sometimes, interleaving the devices geometrically or alternating their orientation strategically can create the desired irradiation pattern at a measuring plane 26. Also, curving the array board or in some manner making it non-planar, such that an effective focal length is created, can provide an appropriate irradiation pattern at a measuring plane 26, but this substantially complicates the manufacturing process of the arrays.

If an engineered component or element such as a diffuser 25, as shown in FIG. 4, is inserted in the irradiation pattern field of the SEDFB device 20, it can function to enhance the divergence or create divergence. Examples of diffusers or diffuser configurations include diffusing arrangements having at least one diffuser. More than one diffuser may also be used in a configuration. It should also be appreciated that an engineered component or configuration used to produce an engineered irradiation pattern according to the presently described embodiments could include a lens, a diffraction grating, a fresnal lens, a mirror, a reflector or a microlens array as an alternative to, as a part of, or as a supplement to the diffusing arrangements contemplated herein. As an example implementation, a microlens array may be matched to the geometry and output of individual devices in an emitter array.

Figure 8A:
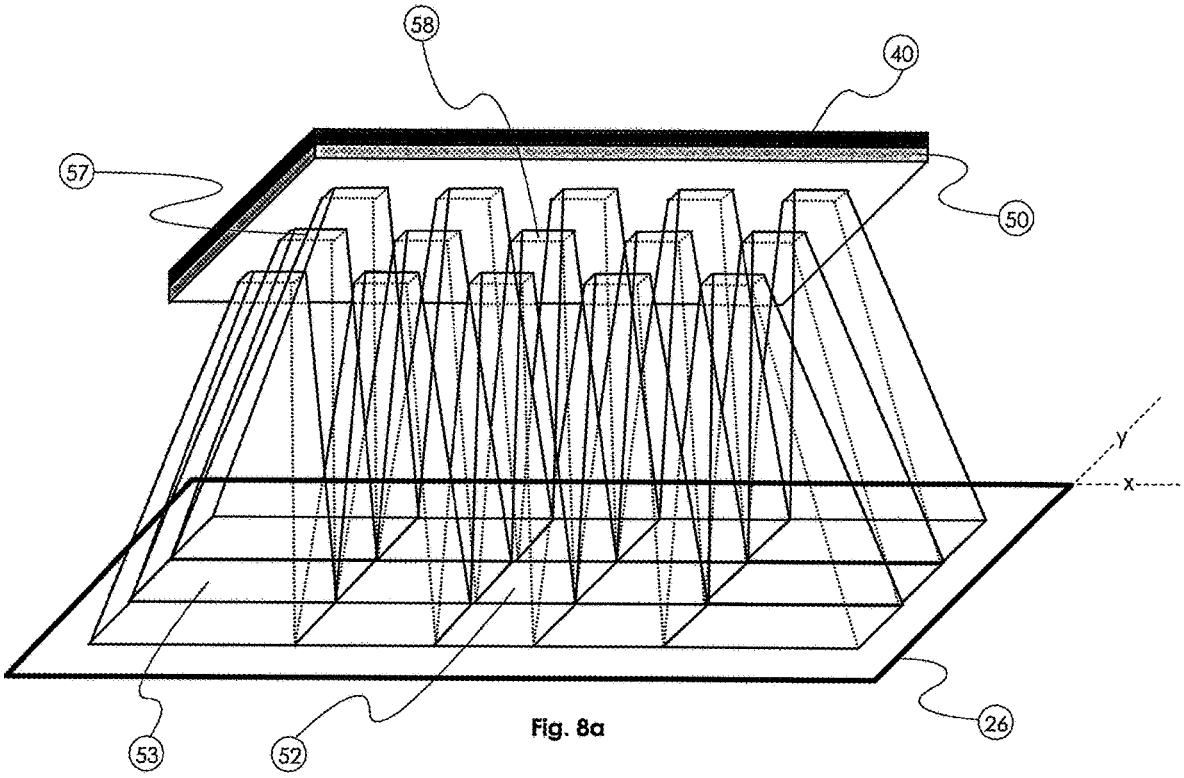
FIG. 8*a* illustrates features of an example embodiment according to the presently described embodiments.
Figure 8B:
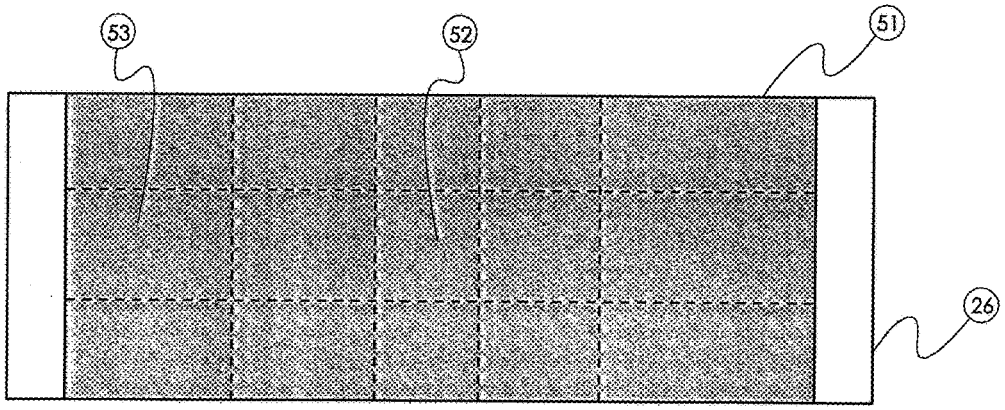
FIG. 8*b* illustrates features of an example embodiment according to the presently described embodiments.

By properly engineering the diffuser, as shown in FIG. 4, either the X direction or Y direction could be modified separately or the same amount. In fact, with the right engineered component such as a diffuser/lensing design, the entire shape of the irradiation output 24 can be changed, for example, from rectangular to round or from rectangular to nearly any desired shape. If the diffusers themselves are arranged into an array configuration 50 as shown in FIG. 8*a*, and interposed between the narrowband array and the target plane 26, then correction can be accomplished to the output of an entire narrowband irradiation array. By inserting the diffuser array 50 in front of the narrowband irradiation array 40 in FIG. 8*a*, the irradiation pattern 51 at the measuring plane 26 can be completely uniform as illustrated in FIG. 8*b*. Each of the engineered diffusers in the engineered diffuser array 50 can be individually tailored for their specific diffusion task. They can have a lensing effect such that the diffusion in the X direction is different than in the Y direction, but also such that the diffusion for devices near the center of the array is different than the diffusion for the devices near the perimeter of the array. A skilled designer can use this to great advantage to put the amount of irradiation energy at each point on the target plane that is desired for the particular use and application. As an example of how this can be used, FIGS. 8 and 8*b* show diffuser section 58, creates the result show in region 52, and has been diffused less in the X direction than region 53 has been, as a result of the effect of its corresponding diffuser section 57.

Figure 9:
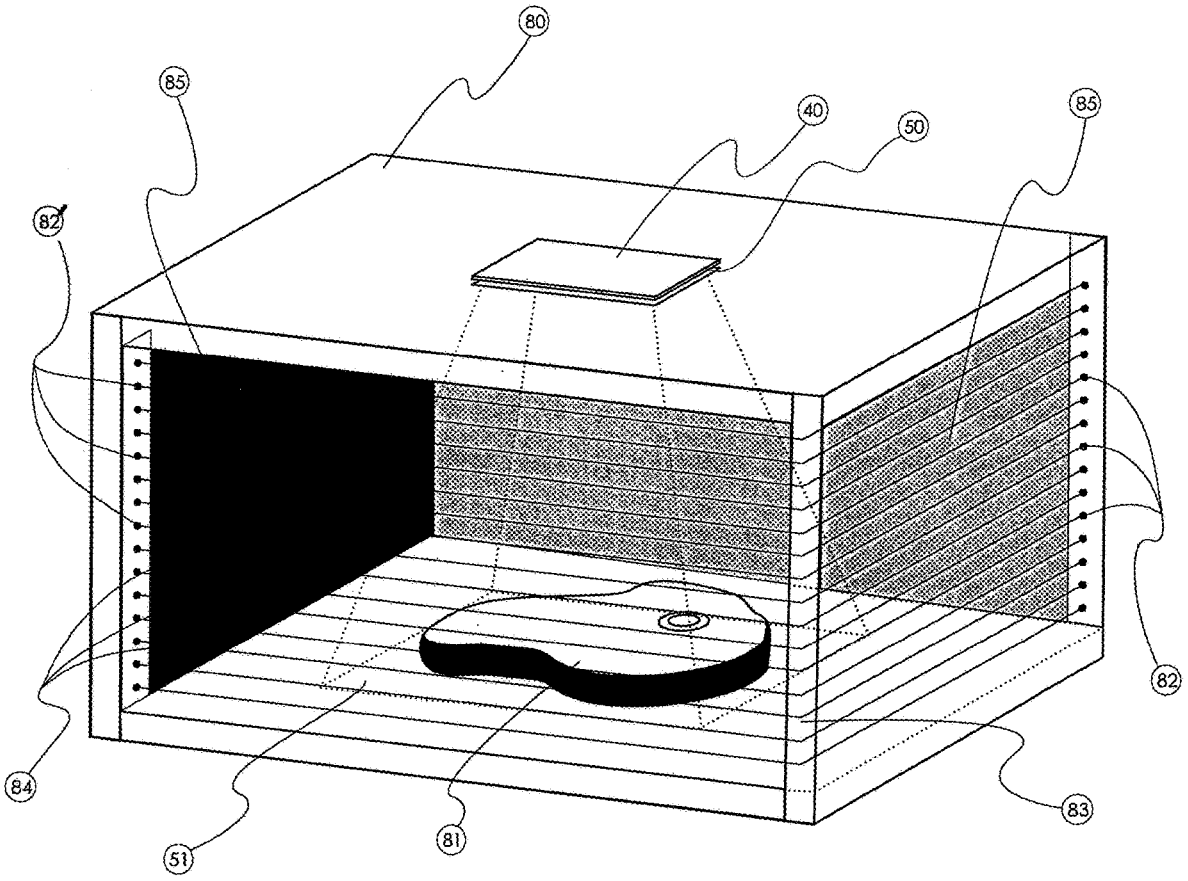
FIG. 9 illustrates features of an example embodiment according to the presently described embodiments.

The concept, as just described above, might desirously be used in an oven (e.g. a food cooking oven) as shown in FIG. 9 which has a narrowband irradiation array 40 (e.g. a narrowband infrared semiconductor based emitter array or arrays including at least one narrowband infrared semiconductor radiation emitting device) with an engineered diffuser array 50 positioned in front of it. It will be appreciated that such food heating and/or cooking systems as contemplated herein, in at least some forms, will advantageously emit infrared energy to match absorptive characteristics of target food items or portions of food items as desired using radiant, direct energy emitted directly from the emitting device to hit the target food item (and, as here, through an engineered component such as a diffuser). While the overall target irradiation region 51 can be targeted but is shown in FIG. 10 as being the product of each engineered diffuser in the engineered diffuser array 50 doing its job accordingly to yield contributing irradiation regions 52, 53 to be of appropriate power and aim region to make the entire target region 51 to be close enough to homogeneous energy levels to be effective at the cooking task at hand.

Figure 10:
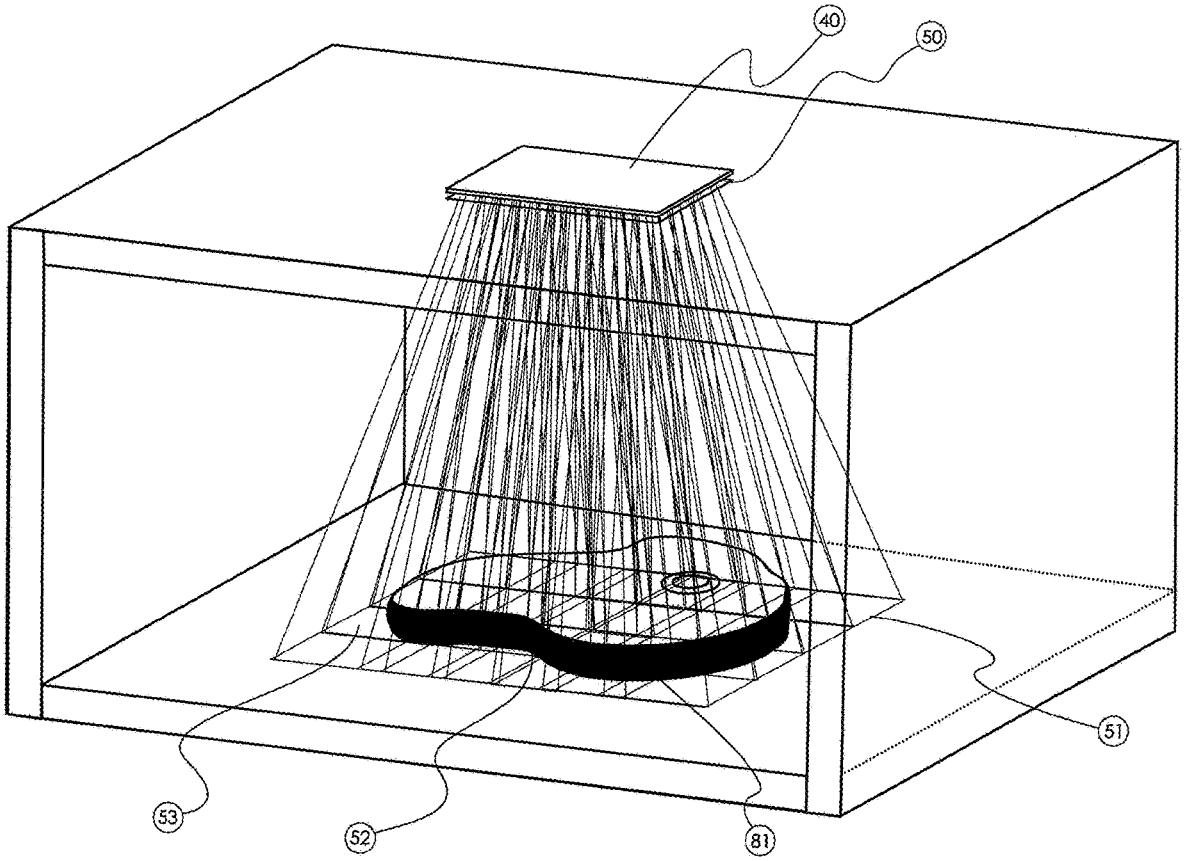
FIG. 10 illustrates features of an example embodiment according to the presently described embodiments.
Figure 11A:
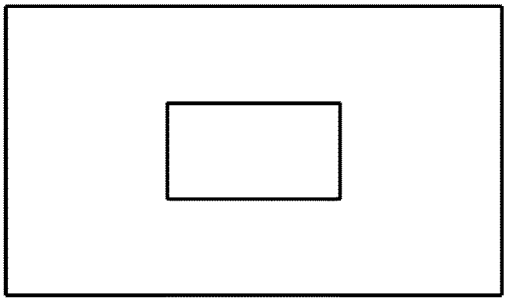
FIG. 11*a* illustrates features of an example embodiment according to the presently described embodiments.
Figure 11B:
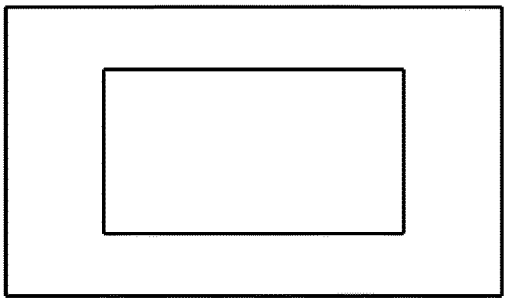
FIG. 11*b* illustrates features of an example embodiment according to the presently described embodiments.
Figure 11C:
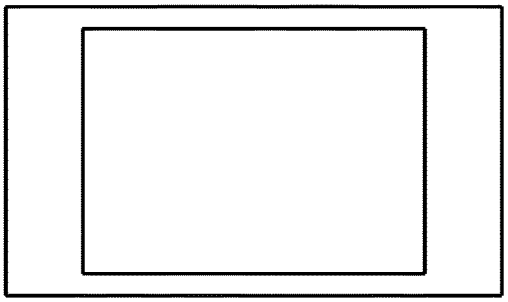
FIG. 11*c* illustrates features of an example embodiment according to the presently described embodiments.
Figure 11D:
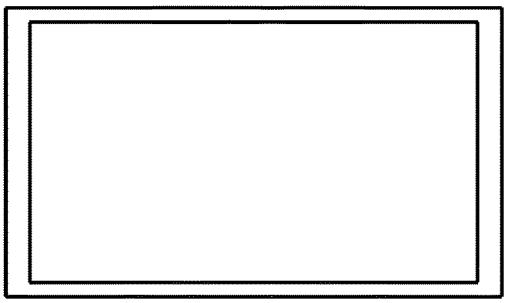
FIG. 11*d* illustrates features of an example embodiment according to the presently described embodiments.
Figure 11E:
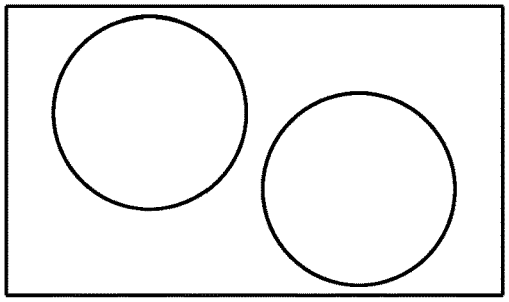
FIG. 11*e* illustrates features of an example embodiment according to the presently described embodiments.
Figure 11F:
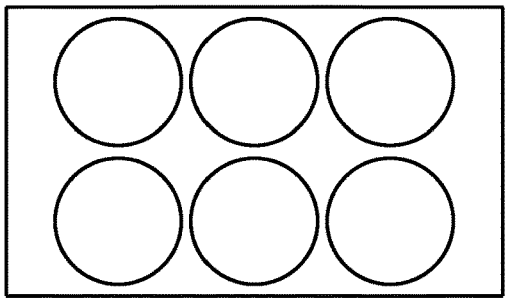
FIG. 11*f* illustrates features of an example embodiment according to the presently described embodiments.
Figure 11G:
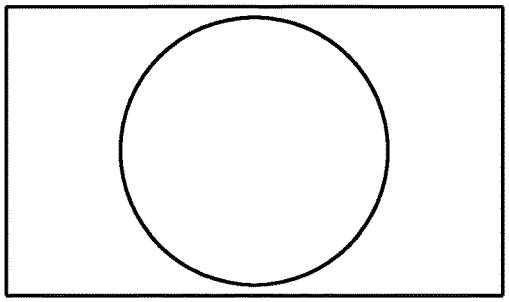
FIG. 11*g* illustrates features of an example embodiment according to the presently described embodiments.
Figure 11H:
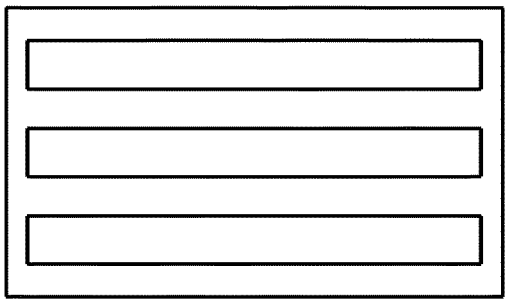
FIG. 11*h* illustrates features of an example embodiment according to the presently described embodiments.

Recognizing that the target region 51 in FIG. 10 represents a single rectangular target region, it would reduce the cooking flexibility of the oven that is so equipped. Although the presently described embodiments are applicable to many different kinds of narrowband heating applications, and is not limited to cooking ovens in any way, cooking ovens will be used as examples. As shown in FIGS. 11*a*-11*h*, there could be many shapes of irradiation targets and, thus, engineered irradiation patterns that would be desired in a cooking oven. Although all are not shown, some include a circle, a square, a triangle, a rectangle, an arc or a plurality of these shapes. FIG. 11*a* shows a small rectangular central region which might be effective for cooking a steak, small entrée, or prepackaged frozen dinner which will fit into that target window. FIGS. 11*b*, 11*c*, and 11*d* could be representative target windows which would be useful for cooking small, medium, or large casserole dish meals respectively. FIG. 11*e* could be useful for cooking two pies or two pizzas simultaneously and concentrating the energy in the respective regions that would be useful. FIG. 11*f* could be useful for six pot-pies or individual dish entrees, and would eliminate the wasted energy that would otherwise fall between the items and not be useful for cooking. FIG. 11*g* would be a useful region for a large pizza and would eliminate the wasted energy around the round perimeter which would be useless for cooking and would be wasted if a pattern such as 11*d* were used instead. 11*h* represents a more unusual target pattern region for three long narrow dishes just to illustrate that the wasted energy that would fall in the two unused bands between the three irradiation target strips would, in this configuration, be concentrated into the useful cooking regions. Engineered, lensing and/or diffusers can be designed to take the energy from a single array and direct it as shown in each of the patterns in FIGS. 11*a*-11*h*.

The heating and holding oven 80 shown in FIG. 9 is shown with two non-opaque sides and two opaque sides 85. As a result of not having full enclosure of the irradiation chamber, there is a clear path through which photonic or irradiant energy can pass to exit the oven 80. Assuming that the photonic energy produced by the narrowband array 40 is properly diffused by the engineered diffusion array 50, then most of the photonic energy is focused in the target region 51 such that the comestible target 81 can be impacted by the narrowband photonic energy. If a person were to reach into the structure 80 to grab the comestible target 81, then his hand and arm would be exposed to the narrowband irradiant energy. To prevent this exposure, a protective "light curtain" can be provided to detect the intrusion of the hand into the confines of the space 80. This could be in the form, for example, of a row of photonic emitters 82'which shoot light beams 84 toward the corner reflector 83, with the corner being configured so that it reflects the light beams 84 to be received by a series of photo receptors 82. This "light curtain" technique has been used successfully in heavy industry to protect dangerous machinery, but has never been used in conjunction with diffused narrowband heating technology. Upon interruption of one or more of the light beams 84 by a hand or body part, a circuit will be dropped out in a control system to either turn off the power to the narrowband array(s) or to at least reduce the power to a safe level.

Figure 12:
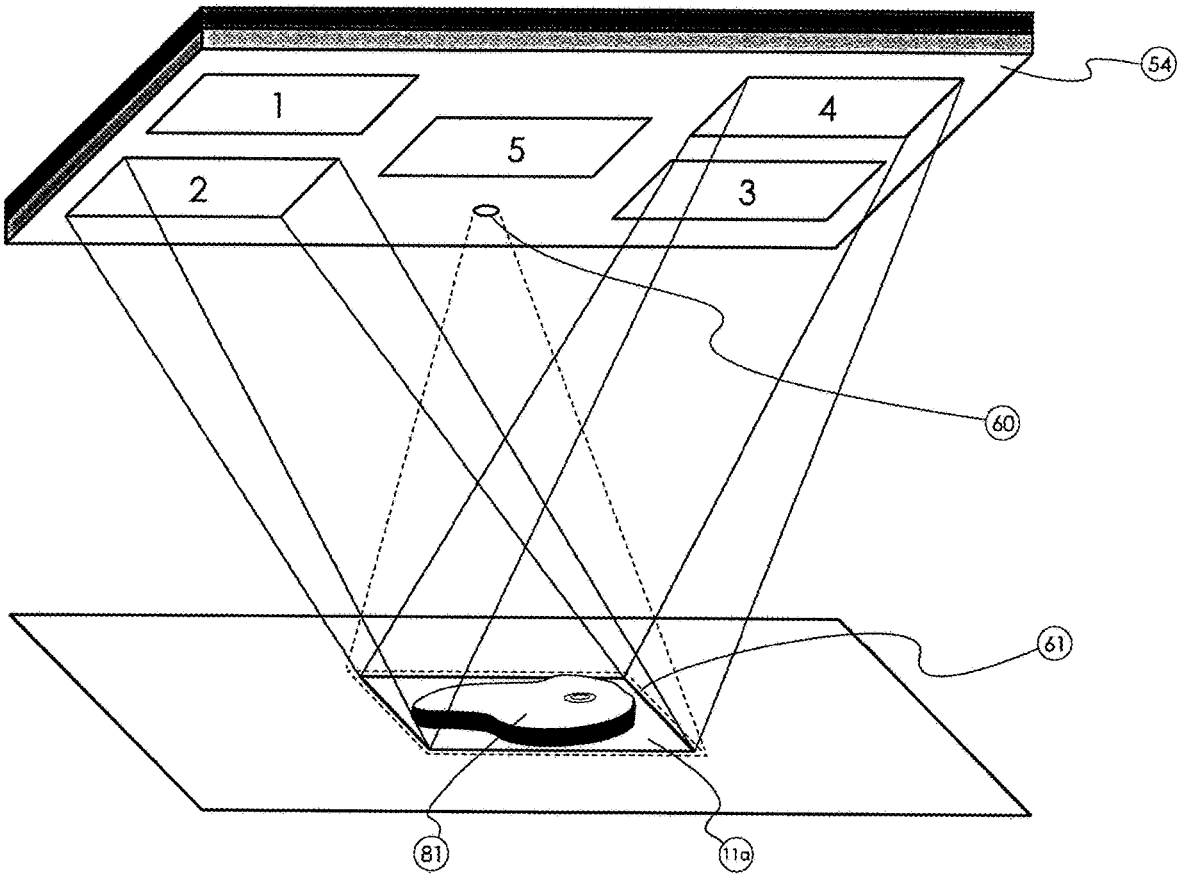
FIG. 12 illustrates features of an example embodiment according to the presently described embodiments.

In order that a consumer might understand the target region in which the food must be placed in order to be exposed to the irradiant energy, an indication system can be associated with the various engineered diffusers that might be in use. A target area may be defined for a user, for example, with at least one of a visible optical pattern projection, a physical marking, or a graphical depiction. In this regard, FIG. 12 shows one way of implementing such indication system 60 comprising, for example, a small light projector which projects an outline perimeter 61 with light. In this version, thus indicating the target region inside which the food must be placed with an outline of easily seen colored light. This could be LED or laser diode powered and could itself have a specially engineered diffuser to provide the appropriate shape through a projection lensing arrangement accordingly. Or, for example, it could be a miniature mirrored galvanometer that continually scans and outlines the cooking target region. It could also take the form of a visible LED or laser diode incorporated into one or more of the narrowband arrays such that a section of the engineered diffuser/lensing array would be interposed in front of it such that it projected its pattern accordingly. More simplistically, an indication means could be designed into the food cooking support arrangement of the oven such that shapes corresponding to the various engineered diffuser arrays could be intuitively understood by the user. The perimeters of the cooking regions could be printed onto the oven components, trays, or cookware which would fluoresce in the presence of UV or IR light. The choice as to how to implement the cooking region indicator would be with the oven designer but would correspond to the engineered array that is selected for use at a given time. Such indicator system could be used in the absence of an engineered diffuser to simply indicate the food placement regions that correspond to either fixed or dynamic aiming of the narrowband irradiation energy. The indicator system could also be used to indicate zones within the target region which might correspond to cooking instructions or cooking recipes. For example, the control system could indicate that the chicken breast should be placed in target region zone 1, while the broccoli should be in zone 2 and the pasta in zone 3. It could show it in a pictorial fashion on screen such that the shapes and zone orientation corresponded to the indication system region spaces. Also, a target may be fit into a fixture to hold the target in a unique location within the target area.

In order to efficiently direct the irradiation energy from a narrowband array to any desired pattern that might be shown in FIG. 11 or others than can be imagined, requires an engineered, lensing diffusion array which is designed specifically for that job. So a designer's challenge might be: "How does one design for a target irradiation area shaped like FIG. 11*a*, and in the same oven, have the ability to hit the target irradiation shape like FIG. 11*c?*".

Figure 13:
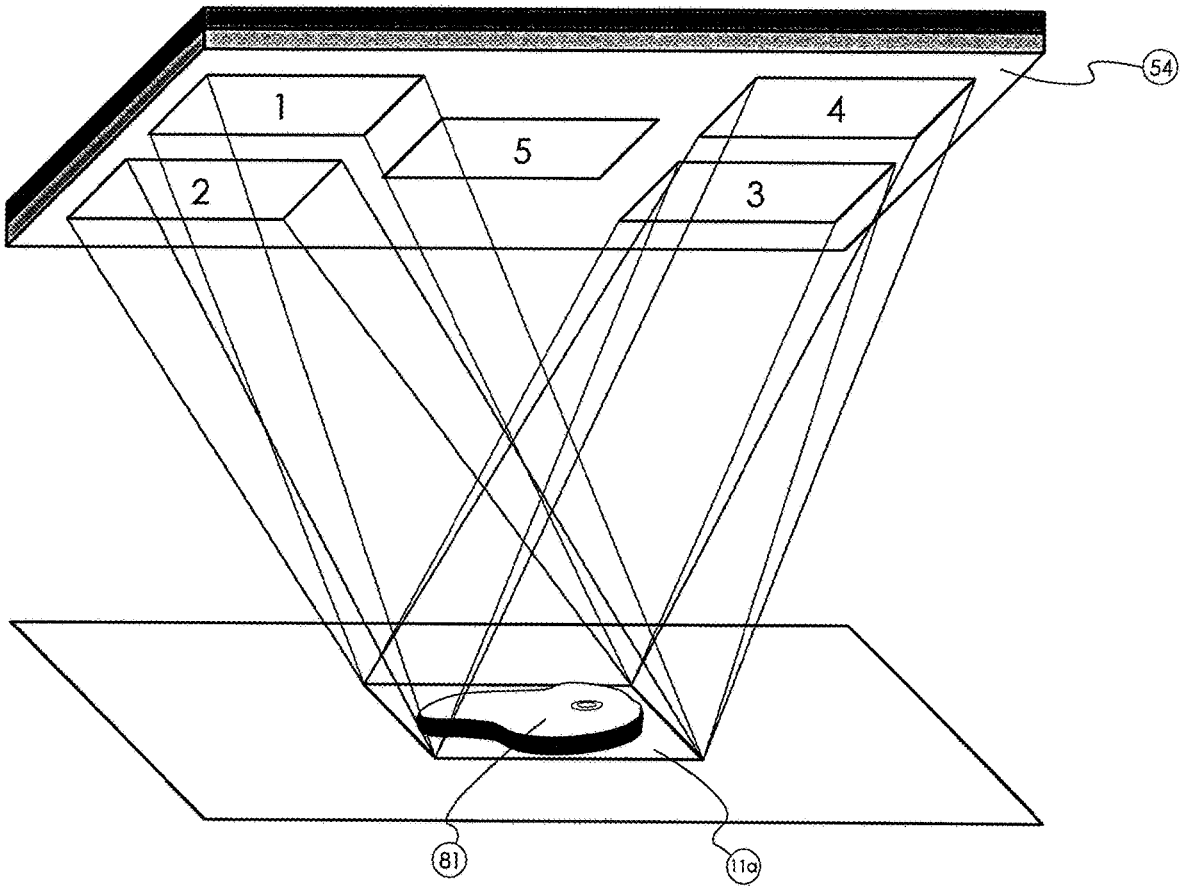
FIG. 13 illustrates features of an example embodiment according to the presently described embodiments.
Figure 14:
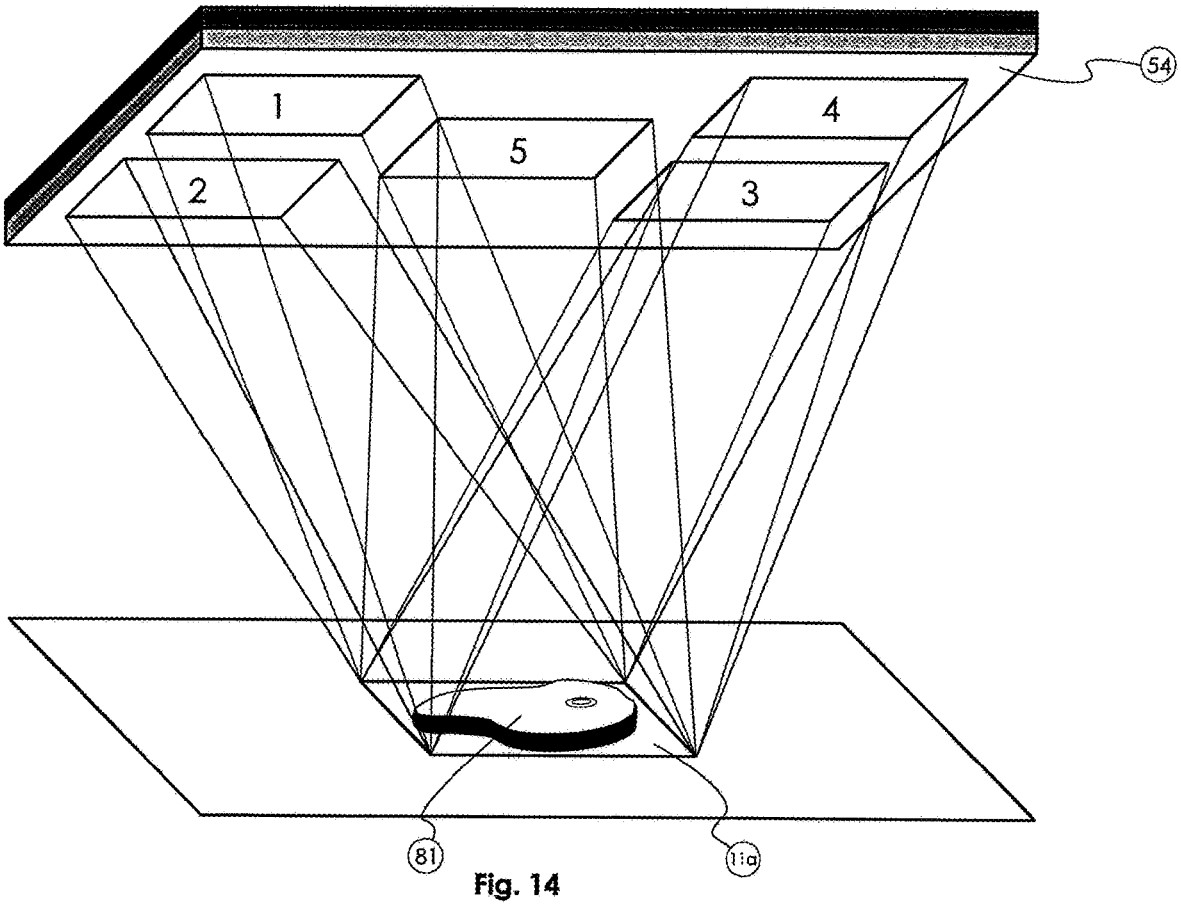
FIG. 14, illustrates features of an example embodiment according to the presently described embodiments.

The answer to this designer's dilemma is to have multiple engineered diffuser/lensing arrays available to be interposed between the narrowband irradiation array and the target region. As shown in FIG. 12, the engineered diffuser/lensing array 54 directs the energy from narrowband irradiation arrays 2 and 3 to the smaller region 11*a*. The diffuser array 54 is designed to also direct the energy from all five of the narrowband irradiation arrays and in FIG. 13 it shows narrowband arrays 1, 2, 3, and 4 turned on and delivering their energy, by way of the diffuser, to the region 11*a*. In FIG. 14, it shows array 5 also being turned on and directed to irradiation region 11*a*, but is shown to indicate that array 5 could be at a different wavelength than the other arrays. The energy from array 5 could be directed to a special section of the region 11*a* if it were desired to have more energy in one zone or section of 11*a* than the others. In fact, any of the arrays 1, 2, 3, 4, or 5 could be directed to or provide a higher energy level to a specific zone within region 11*a* if the diffuser array 54 were designed accordingly.

Figure 15:
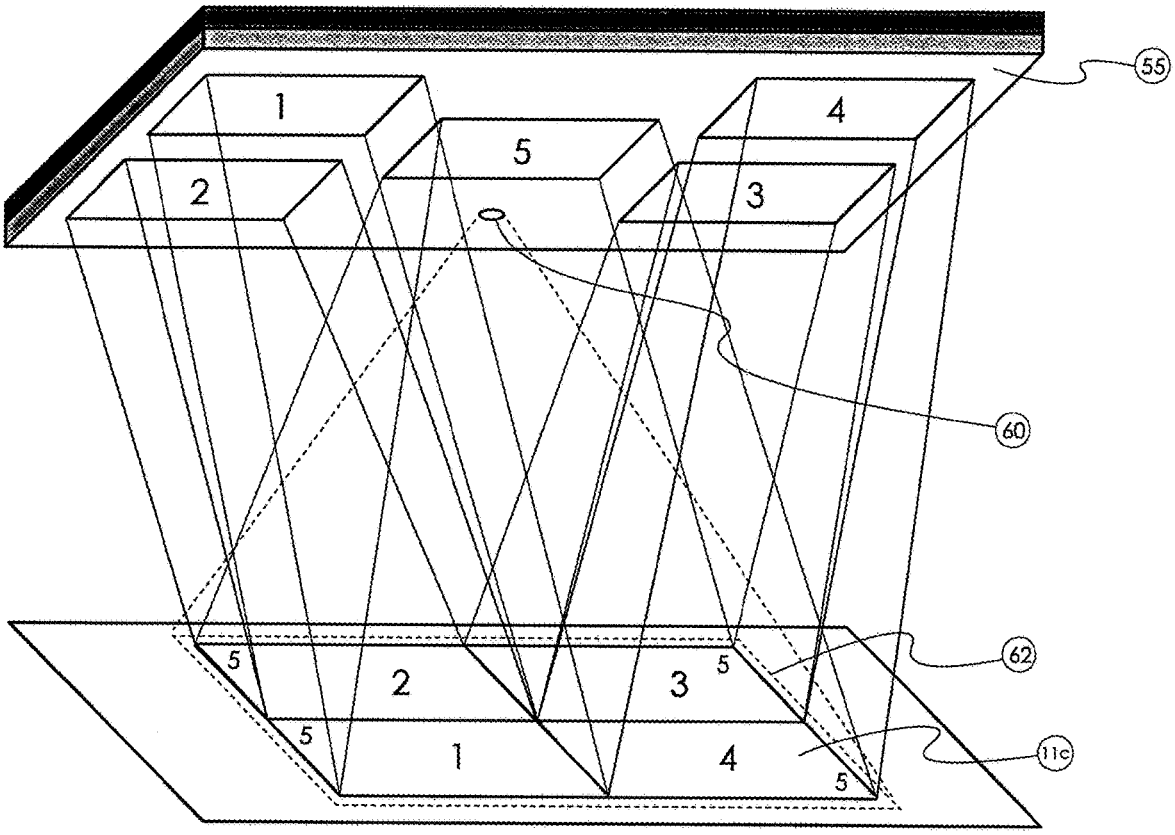
FIG. 15 illustrates features of an example embodiment according to the presently described embodiments.

Now, if array 55 in FIG. 15 is substituted instead of array 54 in FIG. 14, the energy from each of the five arrays could be redirected to the larger target area 11*c*. Again, the engineered diffuser would direct the irradiation energy from each of the respective narrowband irradiation arrays to the appropriate sector of the target region 11*c*. The respective sectors are numbered 1, 2, 3, and 4 to represent the energy coming from those narrowband irradiation arrays. The surface area of the target region 11*c* is four times the area of region 11*a*, so the energy intensity per unit area will be one fourth, but the capability to cook something that is a larger target is gained. Note that the energy from narrowband irradiation array 5 is directed evenly to the entire 11*c* target region. This is shown by example that if the narrowband irradiation array 5 were producing a different wavelength irradiation, for example, for surface browning (e.g. wherein one wavelength, e.g. the browning wavelength, is separated from another wavelength being used, e.g. the cooking wavelength, by at least or approximately 100 nm or more—such as being separated by at least 175 nm), that it could be directed and controlled completely separately from any of the other irradiation arrays. The overall concept here is that each of the engineered arrays 54, 55 could be interchanged with the other as needed. One skilled in the art will understand that this could be mixed and matched to suit a particular oven design and to accomplish the purposes envisioned by the designer.

The different diffusers could be interchanged in a variety of different ways. The diffusers could be interchanged manually/mechanically with one another or they could be pushed in place by any number of types of mechanical or electromechanical actuators. The control system could control such actuators and respond when the recipe, sensors, camera information, or user input dictated a particular configuration. Also, the specific configuration of diffusers being used may be reported to the control system or the user.

The number of types of interposable engineered diffusers can be whatever is required to meet the needs of the oven designer, consumer preferences, and price point. In this regard, whether one diffuser or a plurality of diffusers are used, these components of the diffuser configuration or arrangement may be mounted to a fixture (as shown herein and in other manners). Such a fixture, in some forms, may take the form of a magazine, carousel or other mechanical arrangement to hold or interchange diffusers. In one form, the magazine, carousel, or interchangeable mechanical mounting is placed in the appropriate location using a unique locating feature. The oven could be designed with a standard engineered diffuser in place upon purchase and then make optional engineered diffusers available in the aftermarket to be purchased and inserted by the consumer as desired. On the other end of the spectrum, a sophisticated oven might have half a dozen different engineered diffusers built in, which would be served into their correct interposed position at the direction of the control system and in response to the cooking needs. All levels of sophistication between would be very real opportunities to implement this invention to get the best combination of cooking functionality, speed, cost, energy efficiency, and cooking results. Cost considerations must be considered and will guide the system designer in large measure as to how automatic or manual a system may be, as well as how much ultimate capability and flexibility should be incorporated.

Figure 16:
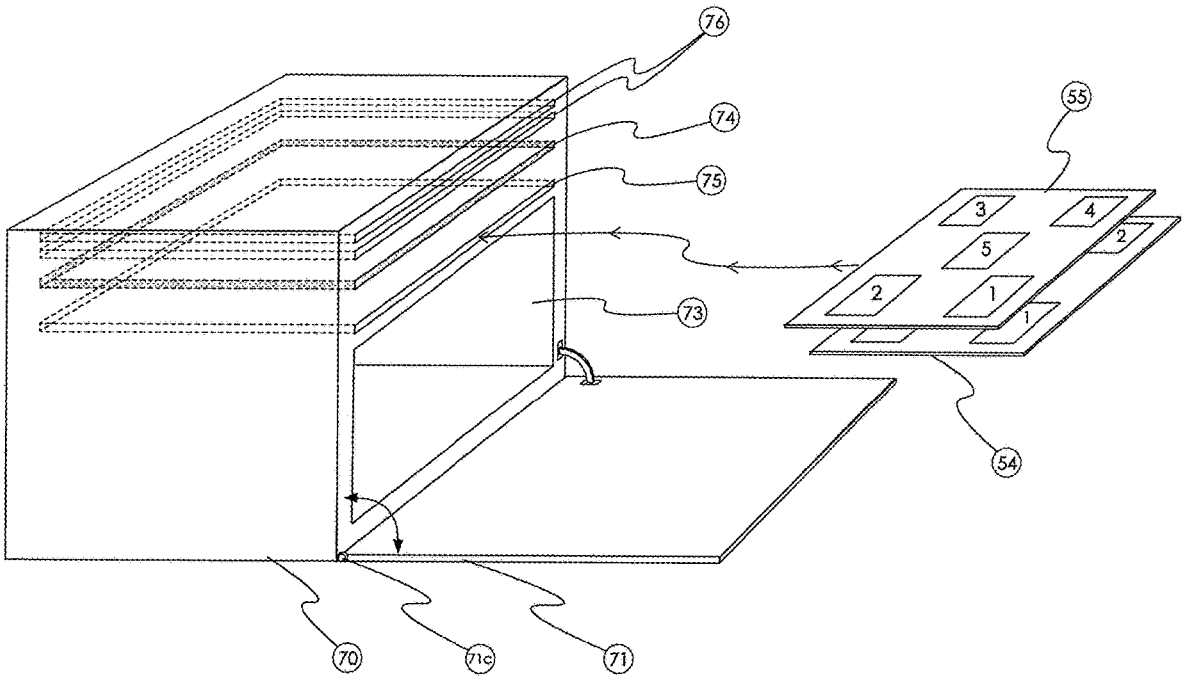
FIG. 16 illustrates features of an example embodiment according to the presently described embodiments.

As an additional example of the interchangeability concept, in FIG. 16, oven 70 which has an oven door 71 which is hinged bilaterally at positions 71*c*, is designed so that it completely covers and encloses the face of the oven. The irradiation arrays are mounted as represented schematically by 74 and 75 represents a slot into which engineered diffuser arrays can be slid into place to interpose the diffuser arrays between the narrowband irradiation arrays 74 and the target area 77 in the oven cavity 73. In FIG. 16 diffusion arrays 54 and 55 represent two different types of diffusion arrays that could be slid into the slot 75 as described. One or more slots as represented by 76 could be provided for storage of any arrays that are not currently in use. The slots represented by 75, 74, and 76 could be inverted and replicated below the oven cavity 73 such that the target area 77 was irradiated from the bottom. By having narrowband irradiation arrays on the top and bottom, cooking can proceed more rapidly and penetration into the food item can be approximately doubled. The oven door 71 could either be made taller in order to cover the slots below the oven cavity 73 and above the oven cavity, or separate doors could be designed, interlocked, and implemented accordingly. Such doors would need to be interlocked electrically for safety so that they cannot be opened when the control system is actuating the system.

Figure 17:
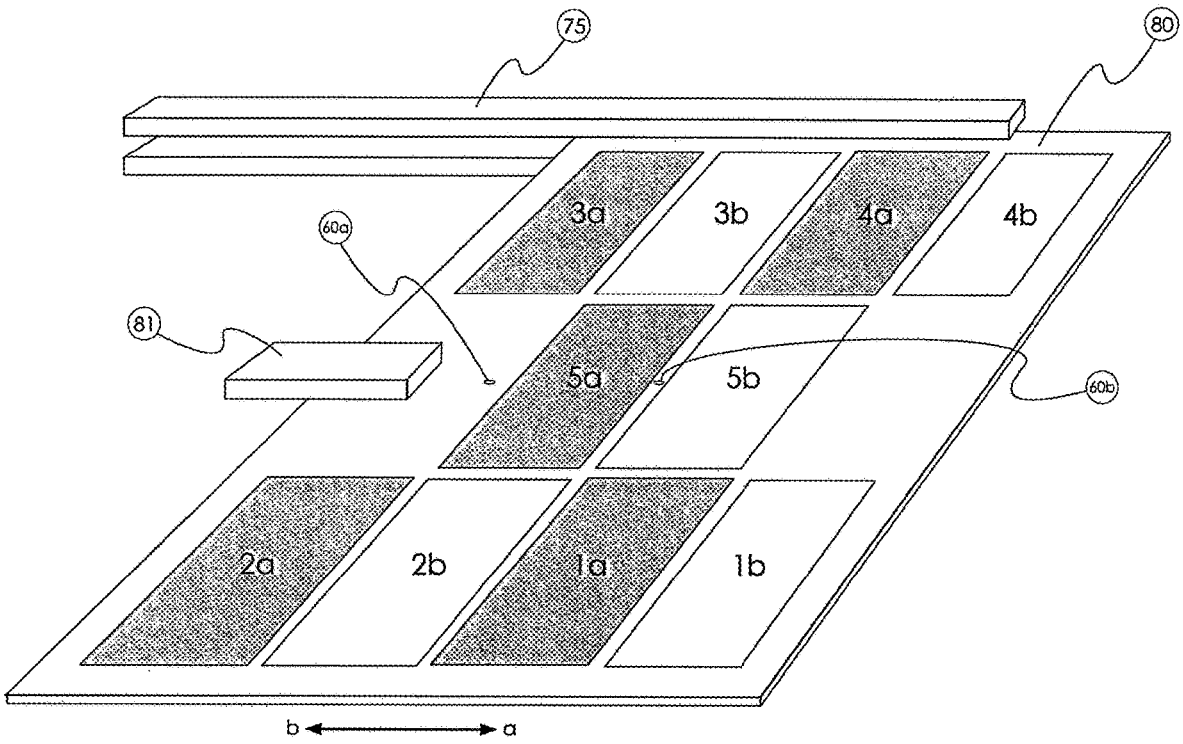
FIG. 17 illustrates features of an example embodiment according to the presently described embodiments.

To automatically interchange two or more different engineered diffusers, the oven designer has a number of different possibilities available to practice this invention. FIG. 17 shows a double engineered diffuser array which is effectively like putting diffuser arrays 54 and 55 on the same plane as represented by diffuser array 80. Notice that diffuser array 80 has a pattern consisting of 1*a*, 2*a*, 3*a*, 4*a* and 5*a*, and also has a pattern consisting of 1*b*, 2*b*, 3*b*, 4*b*, and 5*b*. Pushing the array into the B arrow direction, would put the corresponding B pattern in front of the narrowband array. Pushing the diffuser array in the A direction would place the A pattern in front of the narrowband irradiation array. The double diffuser array 80 could slide in a track represented by 75 which could flank and contain the engineered diffuser 80 on both ends. To automatically move the double engineered diffuser array 80 into either of its two positions, actuator 81 could provide the motive force. As has been mentioned before, the motive force could be derived from a motor, a servo drive, an air or hydraulic cylinder, or other mechanical or electro-mechanical means. It would be under the direction of the control system which would determine when it should move the array into the position a or position b which would be done at a time when the narrowband irradiation array was not actuated. The target area indicator 60*a* could project the correct target outline when the 'A' pattern is used whereas 60*b* could provide a similar function for the 'B' pattern target area. The above example is certainly one way of accomplishing the manual or automatic interchanging of the engineered diffusion arrays but it will be appreciated that many variations on this theme could be implemented according to the designer's specific application, spatial and functionality needs.

It will also be appreciated that methods according to the presently described embodiments may be performed according to the features and descriptions detailed above. For example, a method for narrowband radiant heating of a target using an engineered irradiation pattern, comprises emitting output narrowband infrared energy from a narrowband infrared semiconductor based emitter system toward a target area into which the target may be positioned, and modifying, using an engineered component arranged in a beam path between the emitter system and the target area, shape and power density of the output energy of the narrowband infrared emitter system to create the engineered irradiation pattern of the output energy in the target area. Also, as another example, a method for narrowband radiant heating of a food item using an engineered irradiation pattern, comprises emitting output narrowband infrared energy from a narrowband infrared semiconductor based emitter array toward a target area into which the food item may be positioned, and modifying, using a diffuser configuration arranged in a beam path between the emitter array and the target area, shape and power density of the output energy of the narrowband infrared emitter array to create the engineered irradiation pattern of the output energy in the target area to heat or cook the food item.

This novel use of engineered components such as diffusers dramatically extends and enhances the capability of narrowband irradiation systems. It should be understood that these concepts of how to use engineered lensing and/or diffusers in conjunction with narrowband irradiation arrays can be used in many different ways and for many different applications to dramatically improve the functionality and energy efficiency.

The invention claimed is:

1. A system for narrowband radiant heating of a target using an engineered irradiation pattern, the system comprising:

a narrowband infrared semiconductor-based emitter system comprising at least one array of surface emitting distributed feedback (SEDFB) laser diodes;

a target area, into which the target may be positioned; and, a plurality of engineered diffuser components, each engineered diffuser component comprising at least one of a microlens array and a reflector array arranged in a beam path between the emitter system and the target area, the engineered component being matched to the geometry and output of individual devices in the array of laser diodes and configured to project shape and power density of output energy of the narrowband infrared emitter system to create one of a plurality of engineered irradiation patterns of the output energy in the target area, wherein the one of the plurality of engineered irradiation patterns includes overlap of the output energy.

2. The system as set forth in claim 1 wherein the emitter system comprises a plurality of arrays of laser diodes wherein laser diodes of the plurality of arrays have energy directed to a specific zone of the target area through corresponding diffuser components.

3. The system as set forth in claim 1 wherein the emitter system produces output energy of at least two narrowband wavelength ranges separated by at least 200 nm, each having a different heating result on the target wherein the target comprises a food item.

4. The system as set forth in claim 1 wherein the engineered diffuser component is mounted in a fixture to hold it in correct relationship with the emitter.

5. The system as set forth in claim 4 wherein the fixture contains more than one engineered diffuser component which is in the beam path.

6. The system as set forth in claim 4 wherein the fixture takes the form of one of a magazine, carousel, or other mechanical arrangement to interchange components.

7. The system as set forth in claim 1 wherein the engineered diffuser component has diffusion characteristics that modify the output of the emitter system to mitigate the optical hazards of the unmodified output.

8. The system as set forth in claim 1 wherein the system has an open-framed arrangement for a user wherein a safety device interrupts the output of the emitter system when the user interacts physically into the target area.

9. The system as set forth in claim 2 wherein each of the arrays of laser diodes is matched with its own engineered diffuser component for modifying the engineered irradiation pattern that is created in the target area.

10. The system as set forth in claim 5 wherein each of the engineered diffuser components modifies the output energy to interact with a specific target with specific power density levels.

11. The system as set forth in claim 1 wherein an additional component is placed in the beam path to protect at least one of the engineered diffuser component or personnel.

12. The system as set forth in claim 11 wherein the additional component is also configured to further modify the output of the emitter system.

13. The system as set forth in claim 1 further comprising at least a portion of a cooking system.

14. The system as set forth in claim 5 wherein at least one of 1) different diffuser components facilitate different radiant intensity patterns and 2) irradiation from each laser diode passes through a specific section of the engineered diffuser component.

15. The system as set forth in claim 6 wherein the interchangeable mechanical mounting facilitates swapping or cleaning of the components.

16. The system as set forth in claim 6 wherein the magazine, carousel or interchangeable mechanical mounting can only be placed within the beam path through the use of a unique locating feature.

17. The system as set forth in claim 1 wherein the plurality of arrays of laser diodes is located in one or more orientations around the target area.

18. The system as set forth in claim 1 wherein the arrays of laser diodes are located above and below the target area.

19. The system as set forth in claim 4 wherein the mounting fixture includes a locating feature to facilitate at least one of uniquely orienting an engineered component or to allow mounting of a correct engineered component for that location.

20. The system as set forth in claim 1 wherein the engineered irradiation pattern is one of a circle, a square, a triangle, a rectangle, an arc or a plurality of these shapes.

21. The system as set forth in claim 1 wherein a distance between the emitter system and the engineered component is designed for the desired size of the engineered irradiation pattern.

22. The system as set forth in claim 1 wherein the target area is defined for a user with at least one of a visible optical pattern projection, a physical marking, or a graphical depiction.

23. The system as set forth in claim 5 wherein a specific configuration of the engineered diffuser component is reported to at least one of a control system or the user.

24. The system as set forth in claim 6 wherein the interchangeable mechanical mounting is changed at least one of automatically and manually, in response to a signal from a control system.

25. The system as set forth in claim 1 wherein the at least one array of laser diodes comprises surface emitting laser diodes, or SEDFB devices.

26. An oven for narrowband radiant heating of a food item using an engineered irradiation pattern, the system comprising:

a narrowband infrared semiconductor-based emitter array comprising at least one array of laser diodes;

a target area, into which the food item may be positioned; and, a diffuser configuration comprising at least one of a plurality of available diffuser components, each diffuser component comprising at least one of a microlens array and a reflector array arranged in a beam path between the emitter array and the target area, the diffuser configuration being matched to the geometry and output of individual devices in the array of laser diodes and configured to project shape and power density of output energy of the narrowband infrared emitter array to create one of a plurality of engineered irradiation patterns of the output energy in the target area to cook or heat the food item, wherein the one engineered irradiation pattern includes overlap of the output energy.

27. The oven as set forth in claim 26 wherein the output energy exceeds 250 watts.

28. The oven as set forth in claim 26 wherein output energy of at least two wavelength ranges separated by at least 175 nm is produced by the emitter array.

29. A method for narrowband radiant heating of a target using an engineered irradiation pattern, the method comprising:

emitting an output of narrowband infrared energy from a narrowband infrared semiconductor-based emitter system comprising at least one array of surface emitting distributed feedback (SEDFB) laser diodes toward a target area into which the target may be positioned; and, modifying, using at least one engineered diffuser component, from a plurality of engineered diffuser components, arranged in a beam path between the emitter system and the target area and being matched to the geometry and output of individual devices in the array of laser diodes, shape and power density of the output energy of the narrowband infrared emitter system to create one of a plurality of engineered irradiation patterns of the output energy in the target area, wherein the one of the plurality of engineered irradiation patterns includes overlap of the output energy.

30. A method for narrowband radiant heating of a food item using an engineered irradiation pattern, the method comprising:

emitting output narrowband infrared energy from a laser diode array toward a target area into which the food item may be positioned; and, modifying, using at least one engineered diffuser component, from a plurality of engineered diffuser components, arranged in a beam path between the emitter array and the target area and being matched to the geometry and output of individual devices in the laser diode array, shape and power density of the output energy of the narrowband infrared emitter array to create one of a plurality of engineered irradiation patterns of the output energy in the target area to heat or cook the food item, wherein the one engineered irradiation pattern includes overlap of the output energy.

* * * * *